US008135303B2

(12) United States Patent
Ai et al.

(10) Patent No.: US 8,135,303 B2
(45) Date of Patent: Mar. 13, 2012

(54) IMAGE FORMING APPARATUS FOR PREVENTING CONTAMINATION OF A BACKSIDE OF A RECORDING MEDIUM

(75) Inventors: Ryuta Ai, Abiko (JP); Yuusuke Torimaru, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 465 days.

(21) Appl. No.: 12/361,899

(22) Filed: Jan. 29, 2009

(65) Prior Publication Data

US 2009/0190950 A1 Jul. 30, 2009

(30) Foreign Application Priority Data

Jan. 30, 2008 (JP) ..... 2008-018725

(51) Int. Cl.
*G03G 15/16* (2006.01)

(52) U.S. Cl. ..... 399/101; 399/50; 399/51; 399/53; 399/66; 399/302; 399/308

(58) Field of Classification Search ..... 399/50–51, 399/53, 66, 101, 302, 308
See application file for complete search history.

(56) References Cited

U.S. PATENT DOCUMENTS

| | | | |
|---|---|---|---|
| 6,175,711 | B1 | 1/2001 | Yoshino et al. |
| 7,251,433 | B2 | 7/2007 | Ai et al. |
| 7,480,470 | B2 | 1/2009 | Ai |
| 2005/0276620 | A1 | 12/2005 | Omata |
| 2007/0242972 | A1 | 10/2007 | Ai |
| 2008/0226313 | A1 * | 9/2008 | Tsuchida et al. ..... 399/66 |

FOREIGN PATENT DOCUMENTS

| | | | |
|---|---|---|---|
| JP | 2000-187405 | A | 7/2000 |
| JP | 2002-14589 | A | 1/2002 |
| JP | 2002-229344 | A | 8/2002 |
| JP | 2004-347662 | A | 12/2004 |
| JP | 2005-242009 | A | 9/2005 |
| JP | 2005-352041 | A | 12/2005 |
| JP | 2006-208996 | A | 8/2006 |
| JP | 2006-276065 | A | 10/2006 |
| JP | 2007-79069 | A | 3/2007 |
| JP | 2007-232748 | A | 9/2007 |
| JP | 2007-240673 | A | 9/2007 |
| JP | 2007-304335 | A | 11/2007 |

* cited by examiner

*Primary Examiner* — Ryan Walsh
(74) *Attorney, Agent, or Firm* — Fitzpatrick, Cella, Harper & Scinto

(57) ABSTRACT

In an image forming apparatus, when backside contamination of a recording material occurs, a control portion carries out control so that a plurality of restoring toner bands having a length L1 longer than a circumference L3 of a secondary transfer roller is formed at an interval L2 at positions in which the restoring toner bands can overlap with control images with respect to a longitudinal direction of the secondary transfer roller and then is transferred onto the secondary transfer roller through an intermediary transfer belt. The restoring toner bands transferred onto the secondary transfer roller stagnate on a fur brush rubbing against the secondary transfer roller to remove an electric discharge product deposited on the secondary transfer roller. The toner stagnating on the fur brush is inverted in charge polarity and then is re-transferred onto the intermediary transfer belt through the secondary transfer roller. The toner stagnates on a belt cleaning device to remove the electric discharge product also from the intermediary transfer belt.

9 Claims, 9 Drawing Sheets

(a)

(b)

(c)

IMAGE FORMING APPARATUS FOR PREVENTING CONTAMINATION OF A BACKSIDE OF A RECORDING MEDIUM

FIELD OF THE INVENTION AND RELATED ART

The present invention relates to an image forming apparatus including a transfer member cleaning device for electrostatically adsorbing and removing a toner image for control transferred onto a transfer member. Specifically, the present invention relates to control for restoring a cleaning performance of the transfer member cleaning device for the transfer member.

An image forming apparatus including a transfer portion at which a toner image is transferred onto a recording material by rotating a transfer member in contact with an image bearing member such as a photosensitive drum or in contact with an image carrying member such as an intermediary transfer belt has been widely used.

Further, an image forming apparatus in which a toner image for control (control image) which is not transferred onto a recording material is formed in an area between toner images for an image to be transferred onto the recording material and is carried on an image carrying member to determine a toner image forming condition and a toner image position for the image has been put into practical use.

Further, an image forming apparatus for obviating backside contamination of a recording material by rotating a cleaning member such as a fur brush in contact with a transfer member to electrostatically adsorption-remove a toner image for control deposited on the transfer member at a transfer portion has also been put into practical use.

Japanese Laid-Open Patent Application (JP-A) 2002-229344 discloses a tandem type image forming apparatus using an intermediary transfer method in which a plurality of toner image forming means are disposed along an intermediary transfer belt. In the image forming apparatus, an electrostatic cleaning device is disposed for the intermediary transfer belt and includes a pair of roller brushes (fur brushes), to which voltages of opposite polarities are applied, which are rotated in contact with the intermediary transfer belt.

JP-A 2000-187405 discloses an image forming apparatus in which an electrostatic cleaning device is provided to a secondary transfer roller for forming a transfer portion, rotating in contact with an intermediary transfer belt. The electrostatic cleaning device rotates an electroconductive roller brush, to which a voltage of an opposite polarity to a charge polarity of a toner image is applied, in contact with the secondary transfer roller to electrostatically adsorption-remove a toner image for control which has been transferred onto the secondary transfer roller at the transfer portion.

The electrostatic cleaning device changes in cleaning performance depending on a balance between an electrostatic adsorption ability of the cleaning member to which a cleaning voltage is applied and a depositing force of toner on the surface of the transfer member. When a toner collecting performance of the cleaning member is lowered or a toner binding force of the surface of the transfer member is increased, the cleaning performance of a transfer member cleaning device for the transfer member is lowered. Further, when the cleaning performance of the transfer member cleaning device is lowered, the toner image for control transferred onto the transfer member cannot be sufficiently removed, so that the backside contamination of the recording material attributable to the toner image for control or density non-uniformity of a backside image during printing on both sides is liable to occur. For example, the backside contamination of the recording material or the like attributable to the toner image for control is liable to occur in the case of continuous formation of an image having a small image ratio. Further, also in the case where an image forming job for a less number of copies such as one-sheet printing is continuously performed to frequently repeat start and stop of image formation, the backside contamination of the recording material or the like attributable to the toner image for control is liable to occur. In addition, in the case of carrying out continuous image formation using a recording material requiring a high transfer voltage or using a recording material having a special surface property, the backside contamination of the recording material or the like attributable to the toner image for control is liable to occur.

In these cases, as described later, it was confirmed that an electric discharge product covered the surface of the transfer member to increase a force of constraint of the toner and that the electric discharge product covered the surface of the cleaning member to stagnate the toner and lower a toner collecting power. Further, it was also confirmed that it was possible to remove the electric discharge product together with toner by applying the toner onto the transfer member and rubbing the transfer member with the cleaning member in a state in which the toner is interposed between the transfer member and the cleaning member.

However, even when the electric discharge product is removed from the transfer member in such a manner, if the electric discharge product is left deposited on the image carrying member, the cleaning performance of the transfer member cleaning device is lowered in a relatively short time, so that the backside contamination or the like is liable to occur again. This problem is conspicuous in a predetermined period after the image carrying member or the transfer member is replaced with new one.

That is, in a brand-new condition, a substance deposited on the image carrying member is small in amount. For that reason, the electric discharge product is liable to deposit on the image carrying member. As a result, surface free energy of the image carrying member is increased by the deposition of the electric discharge product, an adsorbing force for adsorbing an external additive from the transfer member side is increased. For that reason, an amount of the external additive on the recording material is small, so that an effect of cleaning the transfer member is lowered.

SUMMARY OF THE INVENTION

A principal object of the present invention is to provide an image forming apparatus capable of restoring a cleaning performance of a transfer member cleaning device for a transfer member.

According to an aspect of the present invention, there is provided an image forming apparatus comprising:

an image carrying member;

toner image forming means for a toner image on the image carrying member;

a transfer member, contactable to the image carrying member, for forming a transfer portion for transferring a toner image from the image carrying member onto a recording material;

wherein the toner image forming means is capable of forming an adjusting image for adjusting a toner image forming condition on the image carrying member, in a state in which the transfer member contacts the image carrying member, in a period between adjacent image forming operations during continuous image formation;

a cleaning member, contactable to the transfer member, for removing toner from the transfer member; and a control portion for controlling the image forming portion so that a toner band is formed in an amount of toner per unit area larger than that of the adjusting image on the image carrying member and then is electrostatically transferred onto at least an area of the transfer member in which the adjusting image is deposited.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, several embodiments of the present invention will be described in detail with reference to the drawings. The present invention can also be carried out in other embodiments in which a part or all of the constitutions of the respective embodiments are replaced by their alternative constitutions so long as a toner image formed in a toner amount which is more than that of a toner image for control is transferred onto a transfer member.

In the following embodiments, only a principal portion concerning formation/transfer of a normal toner image will be described, but the present invention can be carried out in various uses including printers, various printing machines, copying machines, facsimile machines, multi-function machines, and so on by adding necessary equipment, options, or casing structures.

First Embodiment

Figure 1:
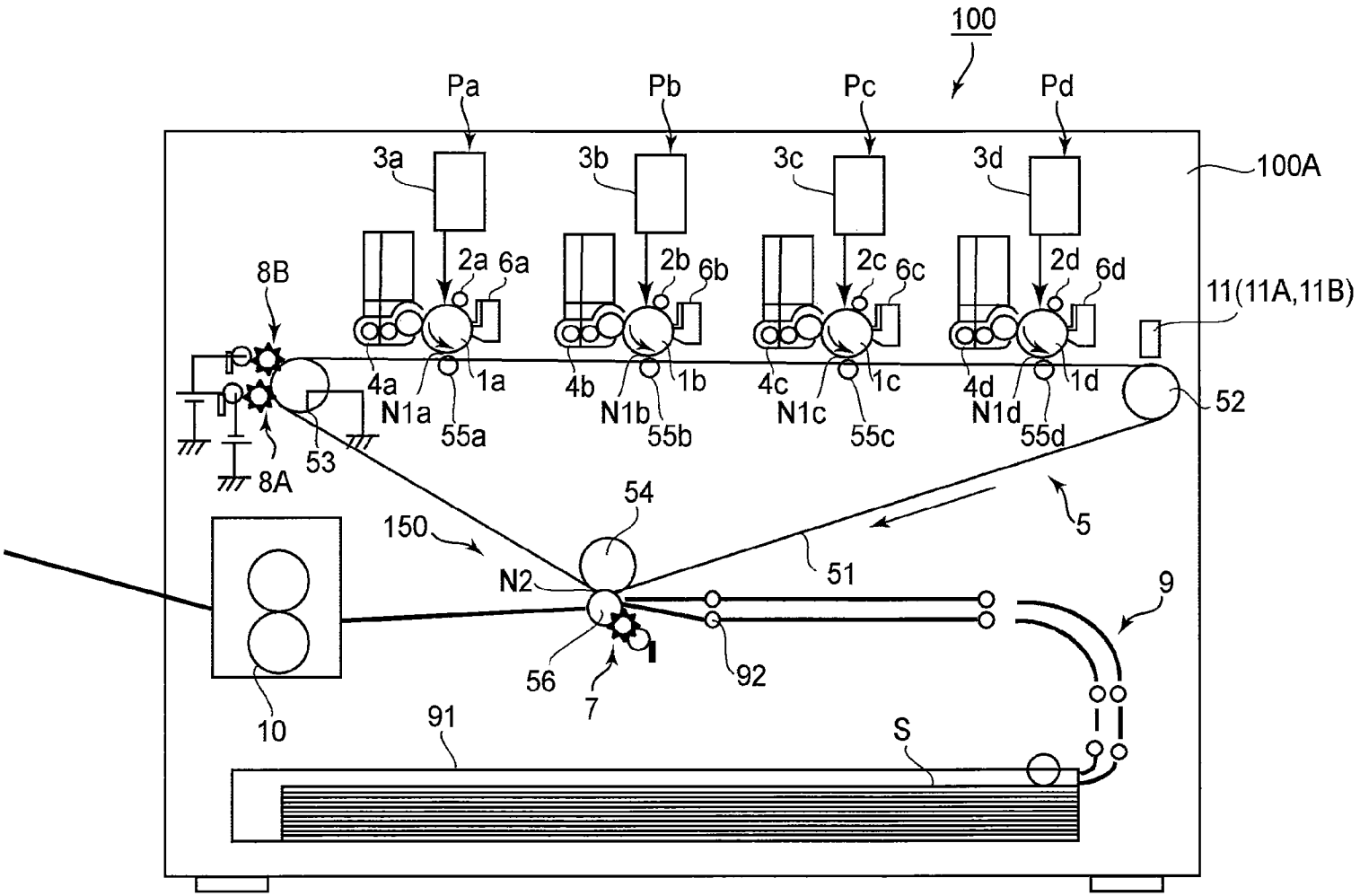
FIG. 1 is a schematic view illustrating a structure of an image forming apparatus of the First Embodiment.
Figure 2:
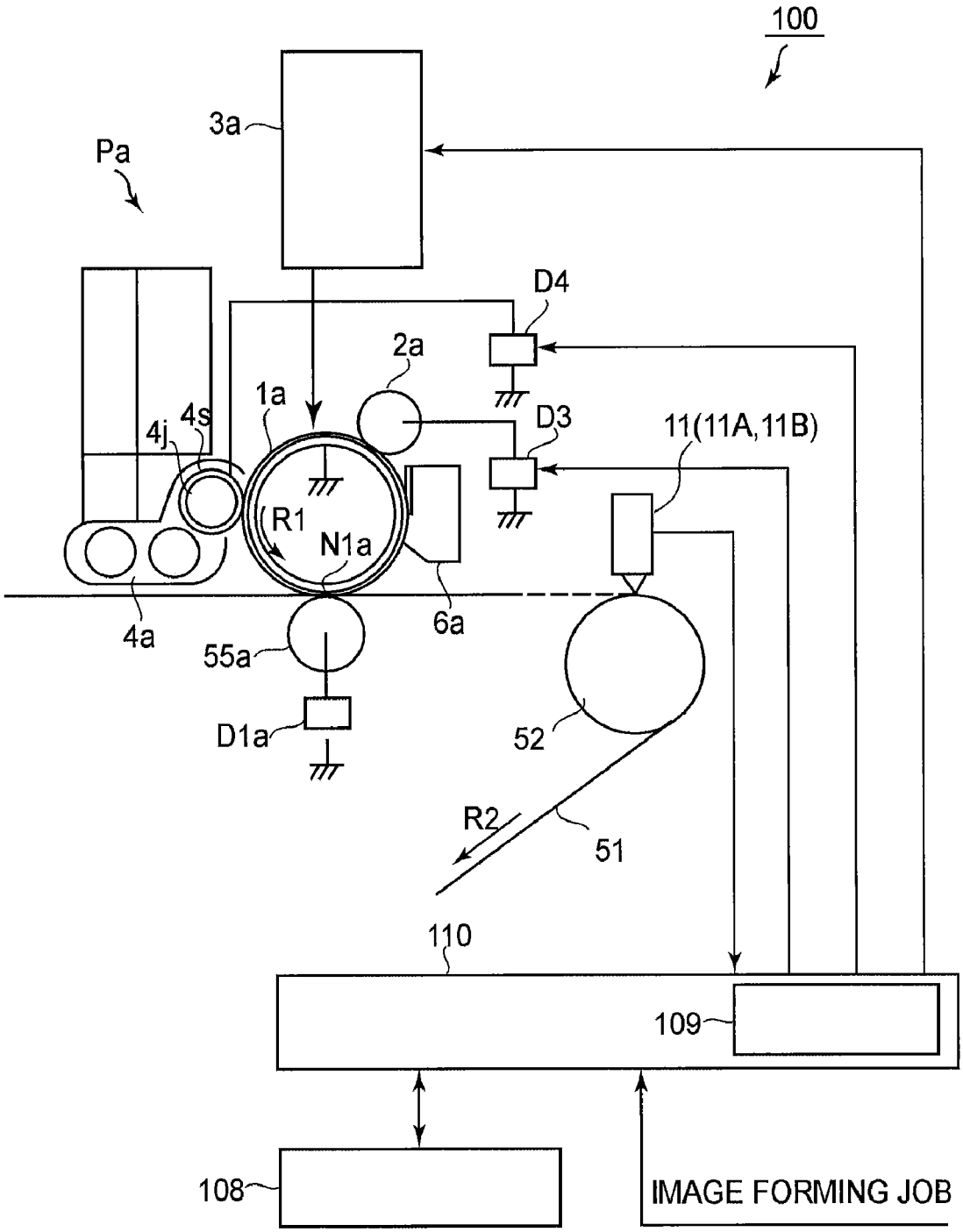
FIG. 2 is a schematic view illustrating a structure of an image forming station.
Figure 3:
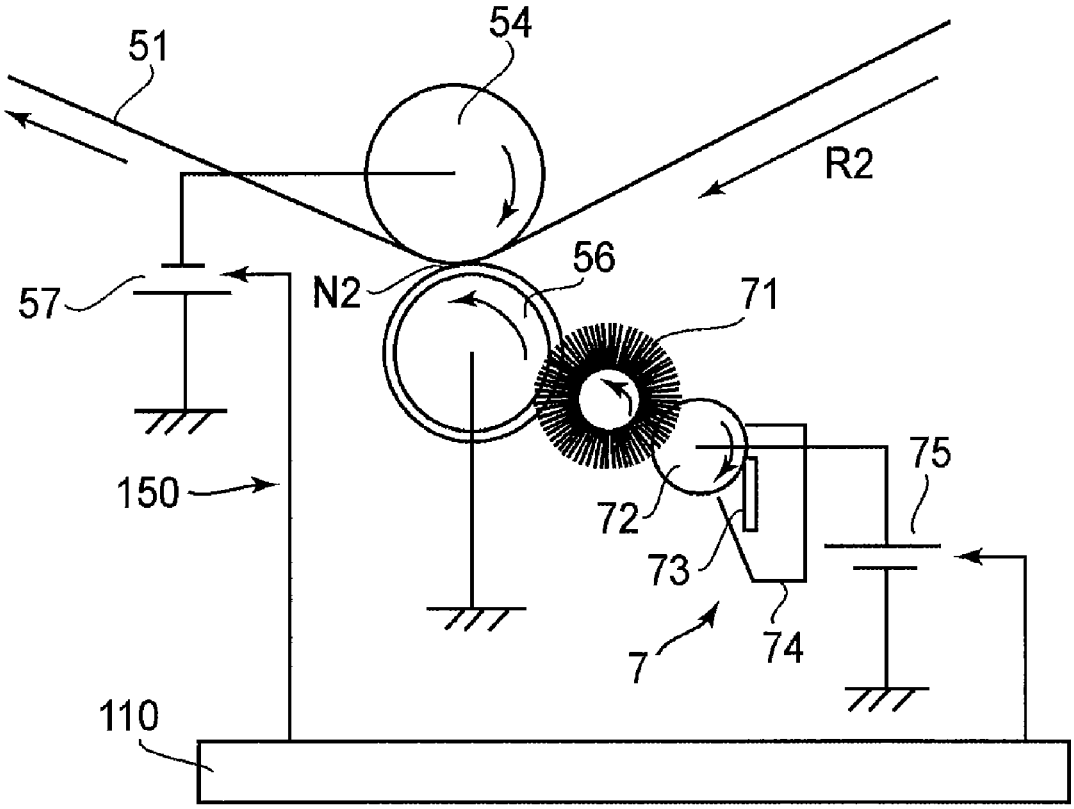
FIG. 3 is a schematic view illustrating a structure of a secondary transfer portion.

FIG. 1 is a schematic view for illustrating a structure of an image forming apparatus of the First Embodiment, FIG. 2 is a schematic view illustrating a structure of an image forming station, and FIG. 3 is a schematic view illustrating a structure of a secondary transfer portion.

As shown in FIG. 1, an image forming apparatus 100 of the First Embodiment is a tandem-type full-color printer of an intermediary transfer type in which image forming stations Pa, Pb, Pc and Pd are linearly arranged at a horizontal portion of an intermediary transfer belt 51. To a main assembly 100A of the image forming apparatus 100, external equipment such as a personal computer, an image reading device, or a digital camera, are communicatably connected. The image forming apparatus 100 forms a full-color image on a recording material S (plain paper, an OHP sheet, etc.) through electrophotography depending on an image signal sent from the external equipment.

The image forming stations Pa, Pb, Pc and Pd form color toner images of yellow, magenta, cyan and black on photosensitive drums 1*a*, 1*b*, 1*c* and 1*d*, respectively, and then primary-transfer the color toner images onto an intermediary transfer belt 51 at the same image position. An intermediary transfer unit 5 including the intermediary transfer belt 51 is disposed oppositely to the photosensitive drums 1*a*, 1*b*, 1*c* and 1*d*. The intermediary transfer belt 51 is formed of an elastic material in an endless belt shape and is extended around a driving roller 52, a tension roller 53 and a back-up roller 54.

The image forming stations Pa, Pb, Pc and Pd have the substantially same constitution except that the colors of toners in two component developers used in a developing devices 4*a*, 4*b*, 4*c* and 4*d* are different from each other. In the following description, only the image forming station Pa will be described with reference to FIG. 2. Further, with respect to the other image forming stations Pb, Pc and Pd, the suffix a of reference numerals (symbols) for representing constituent members (means) is to be read as b, c and d, respectively, for explanation of associated ones of the constituent members.

As shown in FIG. 2, the image forming station Pa includes the photosensitive drum 1*a*. Around the photosensitive drum 1*a*, a charging roller 2*a* is a primary charging means, an exposure device 3*a* is an exposure means, the developing device 4*a* is a developing means, and a cleaning device 6*a* is a cleaning means are disposed in the image forming station Pa.

The photosensitive drum 1*a* as an image bearing member is a drum-like photosensitive member and is rotationally driven in a direction of R1. An intermediary transfer belt 51 is rotated in a direction of an arrow R2 by a driving force transmitted to a driving roller 52. On an inner peripheral surface side of the intermediary transfer belt 51, a primary transfer roller 55*a* is disposed at a position opposite to the photosensitive drum 1*a*. The primary transfer roller 55*a* presses the intermediary transfer belt 51 against the photosensitive drum 1*a* to form a primary transfer portion (primary transfer nip) N1*a*.

During full-color image formation, the charging roller 2*a* is rotated by rotation of the photosensitive drum 1*a* by being supplied with a charging voltage, in the form of a PC voltage biased with an AC voltage, from a power source D3 to electrically charge the surface of the photosensitive drum 1*a* to a uniform dark portion potential.

The exposure device 3*a* scanning-exposes the charged surface of the photosensitive drums to a laser beam, through a polygon mirror or the like, obtained by two-value modulation depending on an image signal of a yellow component color of an original. As a result, a charge potential of a charged portion is lowered to a light portion potential VL, so that an electrostatic image depending on the image signal of the yellow component color is formed on the photosensitive drum 1*a*.

The developing device 4*a* stirs two component developer principally comprising non-magnetic toner and a magnetic carrier to electrically charge the non-magnetic toner to a negative polarity and the magnetic carrier to a positive polarity. The charged two component developer is carried, with a chain thereof, on a surface of a developer-carrying member 4*s* rotating around a fixed magnetic pole 4*j*, thus rubbing against the photosensitive drum 1*a*. To the two component developer, silica particles which is called an external additive having an average particle size of 150 nm is added in an amount of 1% at a weight ratio to the non-magnetic toner in order to improve a charging characteristic of the toner.

A power source D4 applies to the developer-carrying member 4*s* a developing voltage in the form of a negative-polarity DC voltage biased with an AC voltage, so that the toner carried on the developer-carrying member 4*s* is moved in an area of the light portion potential VL of the photosensitive drum 1*a* to develop the electrostatic image into a yellow toner image.

The primary transfer roller 55*a* presses the intermediary transfer belt 51 against the photosensitive drum 1*a*, thus forming the primary transfer portion N1*a* at which the intermediary transfer belt 51 contacts the photosensitive drum 1*a*. The yellow toner image reaches the primary transfer portion N1*a* by the rotation of the photosensitive drum 1*a*.

A power source D1*a* applies a DC voltage, to the primary transfer roller 55*a*, of a polarity opposite to the charge polarity of the toner, so that the yellow toner image is primary-transferred from the photosensitive drum 1*a* passing through the primary transfer portion N1*a* onto the intermediary transfer belt 51.

Then, transfer residual toner remaining on the photosensitive drum 1*a* having passed through the primary transfer portion N1*a* is removed by cleaning with the cleaning device 6*a*, so that the photosensitive drum 1*a* is subjected to a subsequent image forming step.

As shown in FIG. 1, the intermediary transfer belt 51 carrying thereon the yellow toner image is conveyed to a subsequent image forming station Pb. Until this time, at the image forming station Pb, a magenta toner image has been formed on the photosensitive drum 1*b* in the same manner as that described above. The magenta toner image is primary-transferred onto the yellow toner image on the intermediary transfer belt 51 in the same superposition manner as that described above.

In a similar manner, a cyan toner image and a black toner image are primary-transferred onto the toner images on the intermediary transfer belt 51 in the superposition manner at primary transfer portions N1*c* and N1*d*, respectively, with progression of image formation at the image forming stations Pc and Pd.

The recording material S is sent from a cassette 91 at a recording material supply portion 9 and is fed to a secondary transfer portion N2 by registration rollers 92 while being timed with the toner images on the intermediary transfer belt 51.

The four color toner images on the intermediary transfer belt 51 are, at the secondary transfer portion N2, secondary-transferred onto the recording material S by a transfer electric field formed between the back-up roller 54 and a secondary transfer roller 56.

As shown in FIG. 3, at a position opposite to the back-up roller through the intermediary transfer belt 51, the secondary transfer roller 56 as a transfer member is disposed. The secondary transfer roller 56 nips the intermediary transfer belt 51 between the secondary transfer roller 56 and the back-up roller 54 to form the secondary transfer portion (secondary transfer nip) N2 at which the secondary transfer roller 56 and the intermediary transfer belt 51 contact each other.

In the First Embodiment, the secondary transfer roller 56 is connected to a ground potential, and a DC voltage of a polarity identical to the toner charge polarity is applied from a transfer power source 57 to the back-up roller 54. However, it is also possible to form a similar transfer electric field in another embodiment in which the back-up roller 54 is connected to a ground potential, and a DC voltage of a polarity opposite to the toner charge polarity is applied to the secondary transfer roller 56.

Then, the recording material S onto which the toner images are transferred is conveyed to a fixing portion 10 (FIG. 1) at which heat and pressure are applied to the toner images, so that the toner images are fixed on the surface of the recording material S as a full-color image.

The transfer residual toner which has passed through the secondary transfer portion N2 and remains on the intermediary transfer belt 51 is removed by cleaning with a first belt cleaning device 8A and a second belt cleaning device 8B which are an example of an image carrying member cleaning device, and the intermediary transfer belt 51 is cleaned.

The first and second belt cleaning devices 8A and 8B clean the intermediary transfer belt 51 by electrostatic fur brush cleaning using electroconductive fur brushes to which opposite bias voltages are applied for the devices 8A and 8B, respectively.

The image forming apparatus 100 is capable of executing a black (single color) mode in which a black (single color) toner image is formed by using only a desired image forming station, e.g., the image forming station Pd. In this case, only at the desired image forming station Pd, the image forming step similar to that described above is performed to form only the black (desired color) toner image on the intermediary transfer belt 51. Then, the desired black toner image is transferred onto the recording material S and thereafter is fixed on the recording material S.

<Image Density Control>

Figure 4:
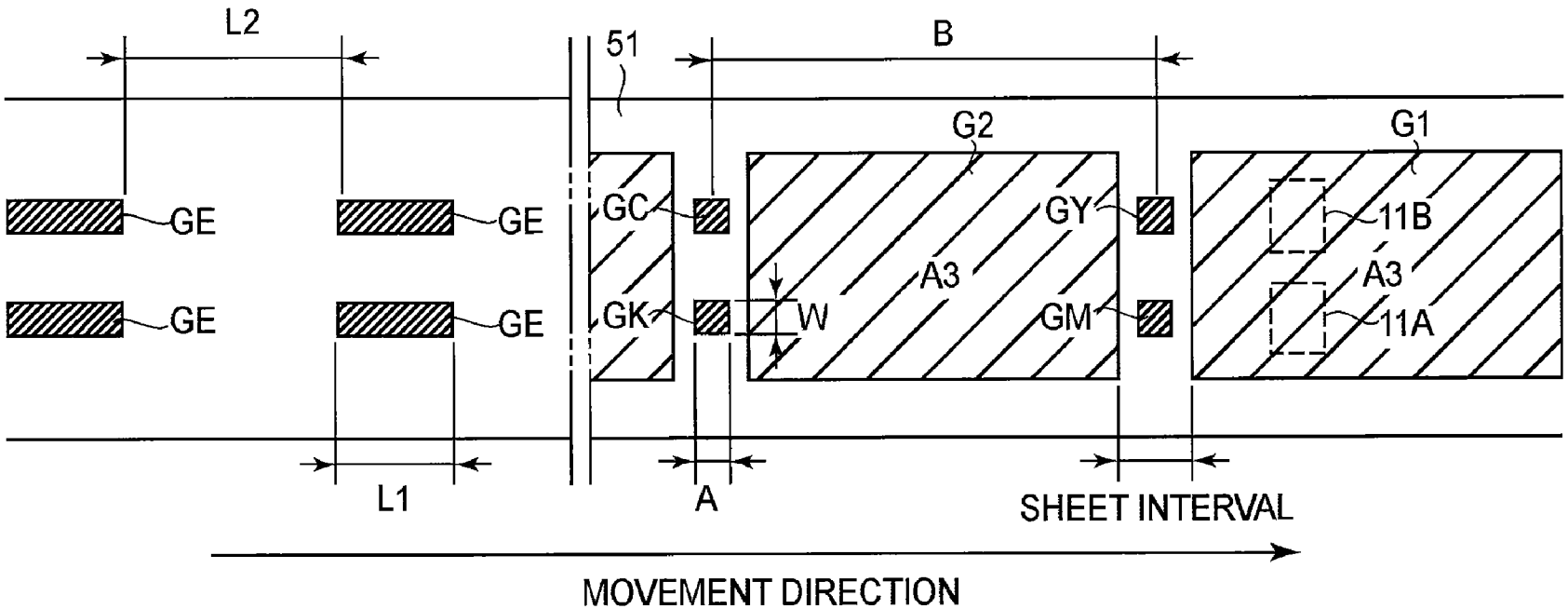
FIG. 4 is a schematic view illustrating an intermediary transfer belt on which a toner image for controlling an image density is carried.

FIG. 4 is a schematic view for illustrating the intermediary transfer belt 51 on which a toner image for controlling an image density. In FIG. 4, control images (reference toner images for control and patch images) to be formed on the intermediary transfer belt 51 are illustrated by taking the case of feeding an A3-size recording material in a longitudinal feeding manner (in which the recording material is fed so that the longitudinal direction thereof coincides with a conveyance direction thereof) as an example.

In the image forming apparatus 100 for performing full-color image output, in order to achieve high-speed and high-quality image formation, retaining color stability and density uniformity is a problem to be solved. For this purpose, the toner image for control (hereinafter referred to as a "control image") is formed in a non-image area of the intermediary transfer belt 51, and a reflection density or the like of the control image is detected and fed back to an image forming process condition or the like, so that a stable image density is retained.

The control image is formed correspondingly to the non-image area, e.g., an area between adjacent recording materials during continuous image formation on a plurality of sheets of the recording material (hereinafter referred to as "sheet interval").

The control image is subjected to a step of forming an electrostatic image (reference electrostatic image for control, a developing step and a primary transfer step in the image forming process similar to that for normal image formation at the respective image forming stations Pa to Pd and then is carried on the intermediary transfer belt 51. During the continuous image formation, at each of the image forming stations Pa, Pb, Pc and Pd, a control image is formed between toner images for an image to be transferred onto the recording material and then is primary-transferred onto the intermediary transfer belt 51.

As shown in FIG. 4, control images GY, GM, GC and GK for yellow (Y), magenta (M), cyan (C) and black (K), respectively, are independently carried between images, to be transferred onto the recording materials, on the intermediary transfer belt 51. Reflected light from the control images GY, GM, GC and GK is detected by image density sensors 11A and 11B as a detecting means.

As shown in FIG. 2 with reference to FIG. 4, a control portion 110 as a control means detects image densities of the control images GY, GM, GC and GK for the respective colors on the basis of output of the image density sensors 11A and 11B.

The image density sensors 11A and 11B are disposed on the outer peripheral surface side of the intermediary transfer belt 51 and at positions in which the control image is readable. In the First Embodiment, the two image density sensors 11A and 11B are disposed at positions opposite to the driving roller 52 (FIG. 2) with respect to a direction (widthwise direction) perpendicular to a movement direction of the intermediary transfer belt 51.

The image density sensors 11A and 11B are a light-reflection type sensor including a light-emitting portion and a light-receiving portion and emits infrared light to the control images GY, GM, GC and GK carried on the intermediary transfer belt 51 and detects regular (specular) reflection light. Detection signals of the image density sensors 11A and 11B are sent to the control portion 110.

The control portion 110 feeds back a density detection result of each of the control images GY, GM, GC and GK for the respective colors to a toner image forming condition at each of the image forming stations Pa, Pb, Pc and Pd, thus controlling an image density for each of the colors.

As image density control in the exposure device 3*a*, preparation or correction control of γ correction table for determining a rule for converting an inputted image signal depending on an apparatus characteristic, an environment, and the like may be carried out.

As another image density control, it is possible to employ control of the image forming process condition (developing contrast, laser power, etc.) or toner concentration control (toner supply control) of the two component developer in the developing device 4*a*.

However, the control itself using the control images may be performed in an arbitrary manner and may also be used for control other than the above-described control, e.g., for adjusting exposure start timing at the image forming stations Pa, Pb, Pc and Pd.

As shown in FIG. 4, the control image is formed every time between toner images for images (at a sheet interval) from the viewpoint of image stabilization. From the viewpoint of productivity, a length of the sheet interval with respect to a surface movement direction of the intermediary transfer belt 51 is set as small as possible, so that only a single control image is formed at the sheet interval with respect to the surface movement direction of the intermediary transfer belt 51. The control image is carried at two positions correspondingly to the positions of the image density sensors 11A and 11B with respect to a direction perpendicular to the surface movement direction of the intermediary transfer belt 51. The control image has a width W (a length in the direction perpendicular to the surface movement direction of the intermediary transfer belt 51) of 20 mm and a length A (a length in the surface movement direction of the intermediary transfer belt 51) of 10 mm.

The length A of the control image may preferably be in the range from 20 mm to 70 mm. When the length A is less than 20 mm, sensitivity of the image density sensors 11A and 11B for reading the control image is lowered, thus being liable to cause an error of reading. On the other hand, when the length A of the control image exceeds 70 mm, a length of the sheet interval requires 90 mm or more, so that there is a possibility of a lowering in productivity (the number of output enable sheets per minute) of the image forming apparatus.

The control image is a halftone image with a density gradation level of 128/255 and is formed in an amount of toner per unit area of 0.35 mg/cm$^2$.

<Secondary Transfer Member Cleaning Member>

As shown in FIG. 3 with reference to FIG. 4, a secondary transfer device 150 includes the secondary transfer roller 56 rotated in contact with a toner image-carrying surface of the intermediary transfer belt 51 which is supported by the back-up roller 54 at its inner peripheral surface and is moved around the supporting rollers.

At the sheet interval between recording materials fed to the secondary transfer portion N2, the control images are not transferred onto the secondary transfer roller 56 by moving the secondary transfer roller 56 apart from the intermediary transfer belt 51 or turning off a transfer voltage applied to the back-up roller 54. However, when such control is effected, a mechanism of the secondary transfer device 150 is complicated, thus impairing accuracy and failing to meet an increase in process speed (the number of sheets for image output per minute) in some cases.

Therefore, in this embodiment, the secondary transfer roller 56 is continuously rotated in contact with the intermediary transfer belt 51 even at the sheet interval of the recording material and the transfer electric field is continuously applied between the back-up roller 54 and the secondary transfer roller 56. For this reason, the control images GY, GM, GC and GK disposed at the sheet interval between the toner images for images to be transferred onto the recording material are transferred onto the secondary transfer roller 56 without being transferred onto the recording material.

Therefore, it is necessary to clean the secondary transfer roller 56 so that the control images GY, GM, GC and GK do not deposit on the back surface of the recording material, having passed through the image area, through the secondary transfer roller 56. The secondary transfer device 150 is provided with a secondary transfer member cleaning device 7 in order to prevent backside contamination of the recording material by quickly removing the control images deposited on the secondary transfer roller 56.

A conventional cleaning device for the secondary transfer roller is generally constituted by a combination of a secondary transfer roller having a surface layer which has been subjected to fluorine coating or the like to stabilize a blade travelling performance, with a blade having a high cleaning performance. Further, from the viewpoint of a conveyance characteristic of the recording material, even in the case of a surface-roughened secondary transfer roller, developing fog toner or the like deposited at the non-image portion in the developing step can be sufficiently removed by cleaning even with the blade.

However, when a high-density toner image such as the control image is completely removed from the surface-roughened secondary transfer roller by cleaning with the blade, it is necessary to increase a contact pressure or contact angle of the blade. The secondary transfer roller and the cleaning blade are an elastic member and have a large frictional force. For this reason, when a linear pressure at a nip portion between the secondary transfer roller and the cleaning blade is increased by increasing the contact pressure or contact angle of the blade, the toner deposits on the cleaning blade, therefore everting of the cleaning blade is liable to occur.

Therefore, in this embodiment, in order to clean the surface-roughed secondary transfer roller, electrostatic fur brush cleaning which is less in surface shape constraint of a member to be cleaned compared with the case of using the blade is employed. In the electrostatic fur brush cleaning, the toner deposited on the member to be cleaned is adsorbed electrostatically by an electroconductive fur brush by application of a DC voltage of a polarity opposite to the toner charge polarity to the electroconductive fur brush. The toner adsorbed by the electroconductive fur brush is electrostatically moved to a metal roller and thereafter is scraped off the metal roller by a cleaning blade, a scraper, or the like to complete the cleaning step.

The secondary transfer roller 56 has a layer structure of two or more layers including an elastic rubber layer and a coating layer (surface layer). The elastic rubber layer is comprised of a foamed layer which has a cell diameter of 0.05-1.0 mm and contains carbon black dispersed therein. The surface layer is formed of a fluorine-containing resin material in a thickness of 0.1-1.0 mm by dispersing therein an ion-conductive polymer.

The secondary transfer roller 56 is a rotatable member having an outer diameter of 24 mm and metal-made central shaft is electrically grounded. The back-up roller 54 is a metal-made rotatable member having an outer diameter of 24 mm.

With respect to a conveyance performance for the recording material, the conveyance performance of the secondary transfer roller 56 is lowered when a surface roughness Rz is 1.5 μm or less. For that reason, the surface roughness Rz of the surface layer of the secondary transfer roller 56 may preferably be controlled to satisfy: Rz>1.5 μm, more preferably be configured to satisfy: Rz>6 μm.

In the case where the toner deposited on the secondary transfer roller 56 is removed by cleaning by the secondary transfer member cleaning device 7 of the electrostatic cleaning type, the cleaning performance is lowered when the surface roughness Rz is 15 μm or more. For that reason, the surface roughness Rz of the secondary transfer roller 56 may preferably be configured to satisfy: Rz≦15 μm, more preferably Rz<12 μm.

The secondary transfer roller 56 is constituted by the elastic member having the surface coating layer and may preferably have the surface layer having the surface roughness satisfying: 1.5 μm<Rz<15 μm, more preferably: 6 μm<Rz<12 μm. Thus, by using the secondary transfer roller 56 which has the surface coating layer and is surface-roughened uniformly, it is possible to stabilize the conveyance of the recording material.

The secondary transfer roller 56 may desirably have an electric resistance value of $1.5\times10^5$ ohm/cm to $1.5\times10^6$ ohm/cm. When the resistance value is lower than $1.5\times10^5$ ohm/cm, current is localized on an outside of the recording material, so that the toner is not supplied with a sufficient electric charge and therefore transferability is impaired. Further, when the resistance value exceeds $1.5\times10^6$ ohm/cm, capacity of a high-voltage power source is insufficient or an applied voltage is excessively increased and thus electric discharge leakage is liable to occur. Therefore, in this embodiment, the resistance value of the secondary transfer roller 56 is $5\times10^5$ ohm/cm.

The transfer power source 57 applies a transfer voltage to the back-up roller 54 during pre-rotation before start of formation of the toner image to be transferred onto the recording material, during transfer of the toner image onto the recording material, and during passing of the toner image for control through the transfer portion. The transfer voltage is a DC voltage of −3 kV which has a polarity identical to the toner charge polarity (negative polarity).

The secondary transfer roller 56 may preferably be rotated at a peripheral speed (surface movement speed) in the range from 200 mm/sec to 500 mm/sec. In this embodiment, the secondary transfer roller 56 rotates at a peripheral speed of 300 mm/sec substantially equal to the rotational speed of the intermediary transfer belt 51, and the back-up roller 54 rotates at the substantially same peripheral speed as that of the secondary transfer roller 56.

A fur brush 71 as the cleaning member is disposed in contact with the secondary transfer roller 56 and negatively charges the secondary transfer roller 56 to remove the toner deposited on the secondary transfer roller 56 from the secondary transfer roller 56 by electrostatic adsorption.

A metal roller 72 is disposed in contact with the fur brush 71 as a voltage application member and applies a cleaning voltage of a positive polarity to the fur brush 71 and removes the toner deposited on the fur brush 71 by electrostatic adsorption. The metal roller 72 may preferably be formed of a material excellent in electroconductivity such as aluminum or SUS.

The metal roller 72 rotates, at a contact portion with the fur brush 71, at a peripheral speed equal to that of the secondary transfer roller 56 and in a rotational direction identical to that of the secondary transfer roller 56.

A cleaning blade 73 is disposed in contact with the metal roller 72 and scrapes off the toner carried on the metal roller 72 and collects the toner in a residual toner container.

A cleaning power source 75 is connected to a rotation shaft of the metal roller 72, as a cleaning voltage output means. A cleaning voltage outputted from the cleaning power source 75 is applied to the fur brush 71 through the metal roller 72. In this embodiment, an output voltage from the cleaning power source 75 is +500 V during image formation for a normal toner image.

By applying the cleaning voltage to the metal roller 72, current passes between the secondary transfer roller 56 and the metal roller 72 through the fur brush 71, so that a potential difference between the secondary transfer roller 56 and the metal roller 72 is generated due to the resistance value of the fur brush 71.

The negatively charged toner electrostatically adsorbed from the secondary transfer roller 56 to the fur brush 71 is moved to the relatively positive metal roller 72 by the above potential difference. The toner carried on the metal roller 72 is rubbed and removed by the cleaning blade 72 contacting the metal roller 72. As a result, the toner collected from the secondary transfer roller 56 is stagnated on the fur brush 71, so that the secondary transfer member cleaning device 7 is prevented from lowering in cleaning performance.

The fur brush 71 may preferably have an outer diameter of 10-30 mm in a state in which the fur brush 71 does not enter the secondary transfer roller 56 as the member to be cleaned, from the viewpoint of a disposed space. In this embodiment, the outer diameter of the fur brush 71 is 18 mm, so that a radius of the fur brush 71 is 9 mm in a state in which the fur brush 71 does not enter the secondary transfer roller 56.

The fur brush 71 has a fur (bristle) length of 4 mm, a depth of impression of a fur tip on the secondary transfer roller 56 of 1.0 mm, and a depth of impression of the fur tip on the metal roller 72 of 1.5 mm.

The fur brush 71 has an implantation density of 120,000/inch$^2$ and an electric resistance value of $3\times10^5$ ohm/cm.

Incidentally, the cleaning device of the electrostatic cleaning type removes the toner on the member to be cleaned with the cleaning member by adsorption through an electrostatic force, so that the cleaning power is lower than that of the case of a blade type. Therefore, the cleaning performance largely varies depending on even a slight change in the depositing force of the toner on the member to be cleaned. This phenomenon is most conspicuous with respect to an electric discharge product produced by electric discharge occurring between the intermediary transfer belt 51 and the secondary transfer roller 56 due to the transfer voltage.

To the secondary transfer roller 56, in order to transfer the toner image for the image onto the recording material, a DC voltage of approximately 1000-4000 V is applied. In such a high-voltage application state, the electric discharge phenomenon occurs between the secondary transfer roller 56 and the intermediary transfer belt 51 or the recording material. The electric discharge phenomenon causes dissociation/bonding reaction with nitrogen and the like in the ambient air to produce the electric discharge product represented by NOx. When such an electric discharge product deposits on the surface of the secondary transfer roller 56, surface free energy is increased to increase a depositing force of the toner particles on the surface of the secondary transfer roller 56. The surface of the secondary transfer roller 56 at which the electrical discharge phenomenon occurs frequently and the surface free energy is high is considerably lowered in cleaning performance of the fur brush 71 when compared with a surface at which the surface free energy is low.

According to a study by the present inventors, in the case where the deposit force of the toner on the secondary transfer roller 56 is increased by the electric discharge product, it has been found that the toner depositing force can be decreased by applying toner onto the surface of the secondary transfer roller 56.

The toner is applied onto the surface of the secondary transfer roller 56 and the secondary transfer roller 56 is rubbed with the fur brush 71, so that surface free energy of the surface of the secondary transfer roller 56 is lowered. Thus, a cleaning performance of the fur brush 71 is restored. In the toner contained in the two component developer, fine particles, which is called an external additive, having a particle size of several tens of nm to several hundreds of μm are contained. The external additive covers the entire toner particles to ensure flowability of the two component developer. Most of the external additive deposits on the toner particles as it is but a part of the external additive is separated from the toner particles to constitute a free external additive.

When the toner is applied onto the secondary transfer roller 56, the free external additive deposits on the fur brush 71 and rubs against the surface of the secondary transfer roller 56, and the external additive deposited on the secondary transfer roller 56 rubs against the surface of the fur brush 71. The external additive constituted by silica or the like functions as an abrasive substance and removes the electric discharge product deposited on the surface to be rubbed. The external additive has a particle size smaller than that of the toner and has a surface area larger than that of the toner, so that an effect of removing the electric discharge product from the surface to be rubbed is large.

The surface of the secondary transfer roller 56 on which the external additive is deposited is less likely to impair the cleaning performance since the external additive is interposed between the control image and the electric discharge product to function as spacer particles even when the control image is formed on the electric discharge product deposited on the surface of the secondary transfer roller 56.

Further, when the electric discharge product deposits on the fur brush 71, the force of constraint of the toner is increased to impair the transfer of the toner onto the metal roller 72, so that the toner adsorbed from the secondary transfer roller 56 stagnates on the fur brush 71 in a large amount to impair the cleaning performance.

For this reason, when the electric discharge product on the fur brush 71 is removed by rubbing between the secondary transfer roller 56 and the fur brush 71 through the toner, the toner is transferred normally onto the metal roller 72, so that the cleaning performance is restored.

<Elastic Belt>

Figure 5:
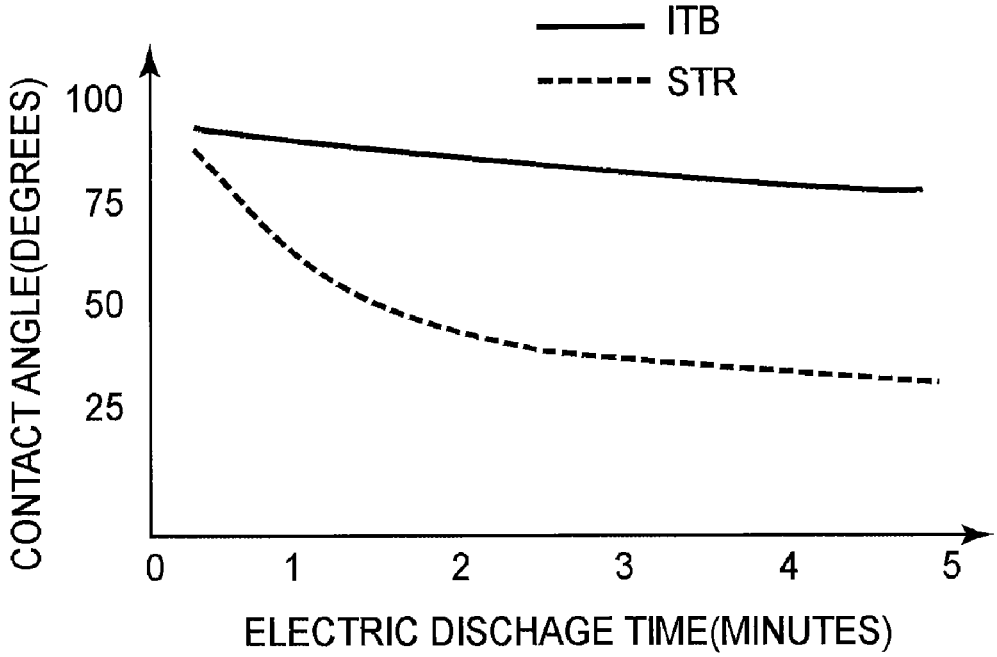
FIG. 5 is a graph showing a change in surface energy of the intermediary transfer belt and a secondary transfer roller in continuous formation to an image with a small image ratio.

FIG. 5 is a graph showing a relationship, between an electric discharge time and a contact angle, for illustrating a change in the surface energies of the intermediary transfer belt ("ITB") and the secondary transfer roller ("STR") in continuous formation of an image with a small image ratio.

In the case where the intermediary transfer belt 51 was an elastic belt having an elastic layer as a surface layer, it was found that the cleaning performance for the secondary transfer roller 56 was deteriorated in a brand-new condition. In the case of the elastic belt, due to softness of the surface thereof, the intermediary transfer belt 51 scrapes the external additive once deposited on the secondary transfer roller 56 off the secondary transfer roller 56 to adsorb the external additive. This phenomenon is conspicuous with respect to the elastic belt in the brand-new condition, which has a large number of soft surface portions exposed at its surface.

Further, due to an electric discharge phenomenon at the secondary transfer portion N2, the electric discharge product is also deposited on the intermediary transfer belt 51. When surface free energy of the intermediary transfer belt 51 is increased by the deposition of the electric discharge product, a force of adsorbing the external additive from the surface of the secondary transfer roller 56 to the intermediary transfer belt 51 is increased, so that the external additive deposited on the secondary transfer roller 56 is moved to the intermediary transfer belt 51. As a result, under such a condition that the intermediary transfer belt 51 is used in an initial stage and, in combination, the electric discharge phenomenon occurs at the secondary transfer portion N2.

As shown in FIG. 5 with reference to FIG. 2, progression of a contact angle of water with the electric discharge time was measured with respect to the secondary transfer roller 56 and the intermediary transfer belt 51 which were deteriorated by electric discharge by performing the continuous formation of the image with the small image ratio.

The lowering in cleaning performance for the secondary transfer roller 56 due to the deposition of the electric discharge product on the secondary transfer roller 56 and the intermediary transfer belt 51 can be quantified by the contact angle of water.

A degree of the lowering in contact angle with the electric discharge time of the secondary transfer roller 56 is more conspicuous than the intermediary transfer belt 51. That is because a circumference (peripheral length) of the secondary transfer roller 56 is incomparably shorter than that of the intermediary transfer belt 51, so that an electric discharge cumulative density per unit length for the circumference is increased and therefore accumulation of the electric discharge product on the secondary transfer roller 56 proceeds more quickly than that on the intermediary transfer belt 51.

Further, in order to prevent the backside contamination of the recording material, it is necessary to highly remove the electric discharge product from the secondary transfer roller 56 to a level such that the control image can be removed by one-time rubbing with the fur brush 51. However, from the intermediary transfer belt 51, the electric discharge product is only required to be removed lightly to the extent that the external additive is not moved from the secondary transfer roller 56 to the intermediary transfer belt 51.

For this reason, there is no need to apply the toner in an amount (thickness) to the extent that the amount is comparable to that for the secondary transfer roller 56. The secondary transfer roller 56 is required to be rubbed with the fur brush 71 holding the toner for a long time but the intermediary transfer belt 51 is only required to be coated with the toner in a small thickness on the circumferential surface of the intermediary transfer belt 51.

When the secondary transfer roller 56 in the brand-new condition is subjected to successive image formation on the recording material, in general, the surface of the secondary transfer roller 56 is covered with the external additive by deposition of the external additive contained in the toner deposited on a non-image portion of the intermediary transfer belt 51.

Further, when the intermediary transfer belt 51 in the brand-new condition is subjected to successive image formation on the recording material, the surface of the intermediary transfer belt 51 is covered with the external additive, so that such a phenomenon that the external additive is adsorbed from the secondary transfer roller 56 by the intermediary transfer belt 51.

Therefore, in the case where both of the secondary transfer roller 56 and the intermediary transfer belt 51 are used in an initial stage, the cleaning performance of the transfer member cleaning device 7 for the secondary transfer roller 56 is considerably lowered. This is because an effect of removing the electric discharge product from the surface of the secondary transfer roller 56 by rubbing with the external additive when the secondary transfer roller 56 and the intermediary transfer belt 51 are used in the brand-new condition is small. This is also because the deposition phenomenon of the external additive on the secondary transfer roller 56 does not proceed, so that the external additive for enhancing the cleaning performance for the control image by the presence thereof between the control image and the electric discharge product is poor in amount. This is further because the external additive deposited on the secondary transfer roller 56 is liable to be taken by the intermediary transfer belt 51.

For these reasons, the backside contamination of the recording material is liable to occur immediately after a user carries out part exchange because of, e.g., and of a lifetime of the secondary transfer roller 56 or the intermediary transfer belt 51. Particularly, the case of carrying out exchange of the secondary transfer roller 56 and exchange of the intermediary transfer belt 51 at the same time is a most severe state. In this case, electrostatic cleaning of the secondary transfer roller 56 with the fur brush 71 is insufficient, so that a light control image is liable to appear at a back surface of the recording material opposite to a surface on which a normal image is formed and the light control image superposed on the normal image at the back surface of the recording material is liable to be observed in the case of image formation on both sides of the recording material.

<Control Means>

As shown in FIG. 4 with reference to FIGS. 2 and 3, the control portion 110 executes a restoring mode in which a restoring toner band GE is formed with timing other than timing of image formation and the toner is applied onto the secondary transfer roller 56 and the intermediary transfer belt 51. The restoring toner band GE is formed over one-full circumference of the intermediary transfer belt 51 so as to have a length L1 (mm), an interval L2 (mm) between adjacent restoring toner bands GE, and an amount of toner per unit area (toner amount) M (mg/cm$^2$). The restoring toner band GE may desirably be formed over the entire circumferential surface in a plurality of positions in which the resultant restoring toner bands GE have a total length which is an integral multiple of a circumference (peripheral length) of the secondary transfer roller 56.

In the First Embodiment, based on a toner charging performance described later, the restoring toner band GE carried on the intermediary transfer belt 51 is transferred from the intermediary transfer belt 51 onto the secondary transfer roller 56 and thereafter is re-transferred onto the intermediary transfer belt 51 in an autonomous manner.

However, the restoring toner band GE may also be forcedly re-transferred onto the intermediary transfer belt 51 by inverting a polarity of an output voltage from the transfer power source 57 and the cleaning power source 75 after the restoring toner band GE is transferred from the intermediary transfer belt 51 onto the secondary transfer roller 56.

In either case, when the secondary transfer roller 56 has an outer peripheral length L3 (mm) and a surface movement speed P (mm/sec), the restoring toner band GE has been re-transferred onto the intermediary transfer belt 51 after lapse of at least L3/P (sec) from the transfer. Then, the restoring toner band GE re-transferred onto the intermediary transfer belt 51 has a toner amount which is not less than that of the toner image for control, i.e., 0.1×M (mg/cm$^2$) or more.

The control portion 110 stops image formation of a normal image when an instruction for a restoring mode is provided, and then executes the restoring mode to eliminate the backside contamination of the recording material attributable to the control images GY, GM, GC and GK. This is because the backside contamination of the recording material can be gradually eliminated also by successive image formation on the recording material but, in a state in which the backside contamination has already occurred, it is necessary to quickly eliminate the backside contamination on the spot.

However, a backside contamination detecting sensor is disposed downstream of the secondary transfer N2 and then the control portion 110 may also execute the restoring mode, without awaiting an operation through the operation panel, when the occurrence of the backside contamination is detected.

Further, as described above, the restoring mode may also be automatically performed during post-rotation in such an image forming job in which the electric discharge product is liable to accumulate on the secondary transfer roller 56 and the intermediary transfer belt 51.

In the restoring mode, the control portion 110 supplies the restoring toner band GE to the secondary transfer roller 56 to remove the electric discharge product deposited on the surface of the secondary transfer roller 56, thus lowering the surface free energy of the secondary transfer roller 56. As a result, the control images GY, GM, GC and GK transferred onto the secondary transfer roller 56 can be satisfactorily removed, so that the backside contamination of the recording material and the image unevenness during printing on both sides.

<Restoring Mode>

In the restoring mode, the cleaning performance of the fur brush 71 for the control images GY, GM, GC and GK which are successively formed at sheet intervals and then are transferred onto the secondary transfer roller 56. The restoring mode is actuated by a manual operation through the operation panel 108 in the state in which the backside contamination of the recording material on which the image is formed occurs.

A start button for the restoring mode is disposed on the operation panel constituted by a liquid crystal touch panel and in the case where the backside contamination of the recording material occurs, the user voluntarily pushes the start button to start the restoring operation.

The restoring toner bands GE are formed with the same width as those of the control images GY, GM, GC and GK at positions with respect to a widthwise direction in which the control images GY, GM, GC and GK are formed on the intermediary transfer belt 56. That is, the cleaning toner image for being transferred onto the transfer member is formed at a position of the toner image for control with respect to a direction perpendicular to the movement direction of the image carrying member.

This is because the high-density control images GY, GM, GC and GK cannot be removed by one-time rubbing with the fur brush 71 unless both of the fur brush 71 and the secondary transfer roller 56 are placed in best condition. At a position deviated from the control images GY, GM, GC and GK with respect to the widthwise direction, there is no toner deposited on the secondary transfer roller 56 to the extent that the backside contamination of the recording material is caused to occur, so that the occurrence of the backside contamination is not caused even when the cleaning performance is lowered. Therefore, there is no need to form the restoring toner bands GE in the first place.

The control portion 110 intermittently forms the restoring toner bands GE in two lines with an interval L2 at thrust positions of the control images GY and GC and the control images GM and GK, respectively. After the restoring toner bands GE are formed, the toner re-transferred onto the intermediary transfer belt 51 in the interval of the restoring toner bands GE is removed and then the intermediary transfer belt 51 is stopped to complete the restoring mode.

Each of the restoring toner bands GE has a length L1 of 75.4 mm and adjacent the restoring toner bands GE have an interval L2 of 500 mm. The restoring toner bands GE are formed of the yellow (Y) toner at a density gradation level of 255/255 higher than that of the control images in an amount of toner per unit area of 0.7 mg/cm$^2$ which is not less than that of the control images.

The restoring toner band GE is formed with the yellow toner image. This is because backside contamination of the recording material is not conspicuous compared with other toners such as the black toner even when image formation is started in a state in which the toner image remains on the secondary transfer roller 56. Therefore, in the case where a developing device using a white toner or a developing device using a transparent toner is provided, the restoring toner band GE is formed with the white toner rather than the yellow toner and should also be formed with the transparent toner rather than the white toner.

<Experiment 1>

In order to evaluate a degree of elimination of the backside contamination when restoring modes with various conditions were executed in a state in which the backside contamination of the recording material occurred, Experiment 1 for intentionally causing the backside contamination was conducted. Experiment 1 is performed in such a mode that the backside contamination of the recording material is acceleratedly caused to occur at a certain level by using the secondary transfer roller 56 and the intermediary transfer belt 51 which are in brand-new condition. The reason why the brand-new secondary transfer roller 56 and intermediary transfer belt 51 are used is as described above.

In Experiment 1, a secondary transfer voltage higher than that at normal setting is applied to the back-up roller 54 and continuous image formation of an image with a low image ratio was carried out. The normal secondary transfer voltage is 2000-4000 V but a DC voltage of 6000 V was applied as that in an acceleration mode of the occurrence of the backside contamination. At this time, an amount of electric discharge current was about two times that at the normal setting.

Evaluation was made under an environment of a room temperature of 22° C. and a relative humidity of 50% and by using an image having an image ratio (image duty) of 2% per the size of the recording material. When the image ratio is set at a low level, a speed of deposition of the toner (external additive) on the secondary transfer roller 56 and the intermediary transfer belt 51 is slow, so that the electric discharge product is acceleratedly accumulated and therefore the backside contamination of the recording material is liable to occur. As the recording material, plain paper for PPC (available from Canon Kabushiki Kaisha) with a basis weight of 80 g/m$^2$ was used. The size of the paper was A3. Under this condition, when the continuous image formation was carried out, the backside contamination of the recording material occurred in image formation on 1000 sheets.

Under the condition in the mode of Experiment 1 in which the backside contamination was caused to occur, verification of two aging methods in Embodiment 1 and Comparative Embodiment 1 described below was conducted.

Embodiment 1

Figure 7:
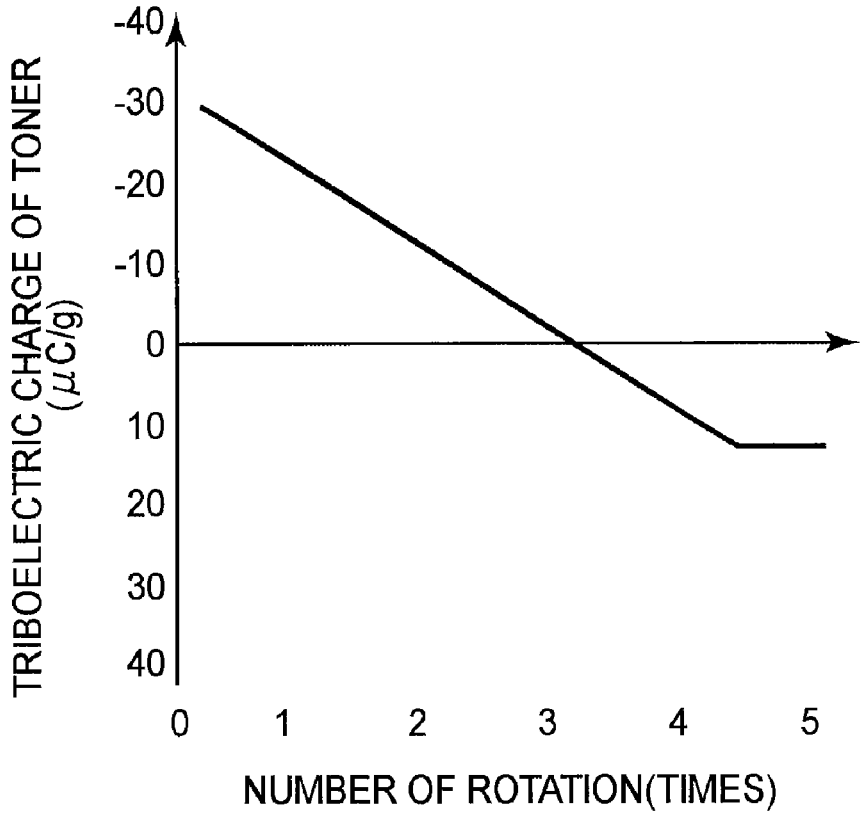
FIG. 7 is a graph showing a change in charge amount of toner held by a fur brush.
Figure 6:
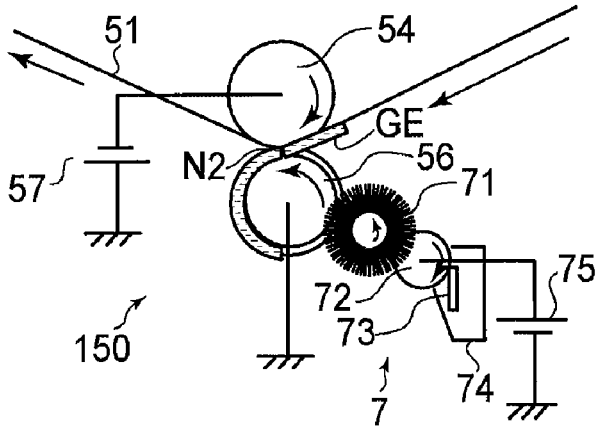
FIGS. 6(*a*), 6(*b*) and 6(*c*) are schematic views for illustrating control in Embodiment 1.
Figure 6:
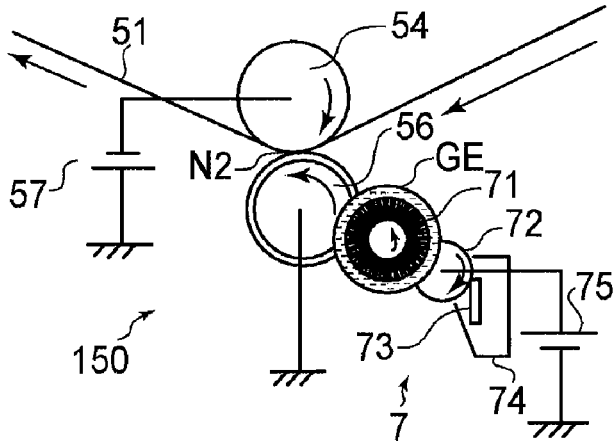
Figure 6:
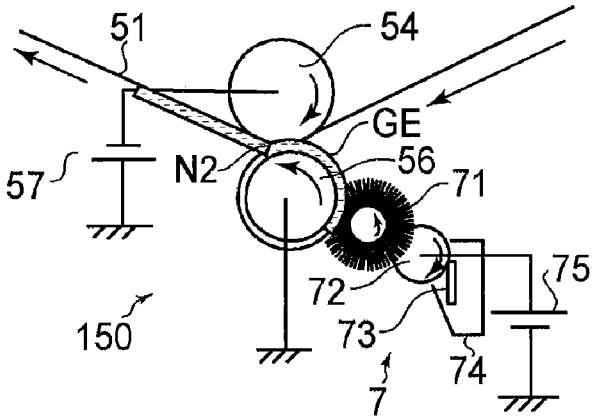
Figure 8:
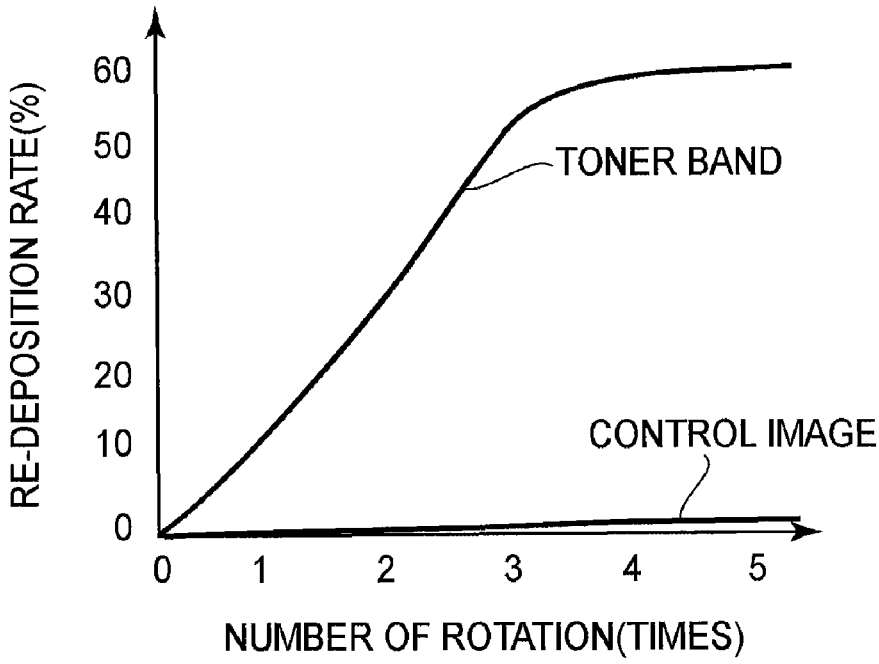
FIG. 8 is a graph illustrating transfer back of a restoring toner band to the intermediary transfer belt.

FIGS. 6(*a*), 6(*b*) and 6(*c*) are schematic views for illustrating control in Embodiment 1. FIG. 7 is a graph showing a relationship between the number of rotation of the fur brush and triboelectric charge of toner held by the fur brush. FIG. 8 is a graph showing a relationship between the number of rotation of the fur brush and a re-deposition rate of the toner onto the intermediary transfer belt, for illustrating transfer back of the restoring toner band to the intermediary transfer belt.

In the control of Embodiment 1, the external additive is applied onto the secondary transfer roller 56 and thereafter was applied onto the intermediary transfer belt 51. In Embodiment 1, the restoring toner bands GE are transferred onto the secondary transfer roller 56 and then are returned to the intermediary transfer belt 51 in an autonomous manner, so that the external additive is deposited on both of the surface of the secondary transfer roller 56 and the surface of the intermediary transfer belt 51.

As shown in FIG. 6(*a*), the restoring toner band GE carried on the intermediary transfer belt 51 is first transferred onto the secondary transfer roller 56 by the secondary transfer voltage, identical to that during the normal image formation, applied to the secondary transfer portion N2.

As shown in FIG. 6(*b*), the length (L1: FIG. 4) of the restoring toner band GE is equal to the circumference L3 of the secondary transfer roller 56, so that the restoring toner band GE is uniformly deposited on the outer peripheral surface of the secondary transfer roller 56.

When the restoring toner band GE reaches a contact portion between the secondary transfer roller 56 and the fur brush 71 to which a normal cleaning voltage is applied, the restoring toner band GE is temporarily adsorbed and held by the fur brush 71. In the case of the control image during the normal image formation, the toner adsorbed and held by the fur brush 71 is almost transferred onto the metal roller 72 and then is scraped off the metal roller 72 by the cleaning blade 73. However, the restoring toner band GE has a large amount of toner, so that the toner is not moved to the metal roller 72 in a short time. Therefore, the large amount of toner is continuously moved by the rotation of the fur brush 71 while being adsorbed and held by the fur brush 71. By the rubbing between the secondary transfer roller 56 and the fur brush 71 adsorbing and holding with a speed difference, it is possible to efficiently deposit the external additive on the secondary transfer roller 56.

FIG. 7 is a graph showing the progression of a measured (tribo-)electric charge of toner stagnated on the fur brush 71. As shown in FIG. 7, the toner held by the fur brush 71 has a long stagnation time on the fur brush 71, so that the toner charge amount is decreased and thereafter a polarity of the toner is inverted. During three full turns of the fur brush 71, the charge amount of toner deposited on the fur brush 71 is lowered from −30 μC/g to −5 μC/g (in terms of an absolute value). Thereafter, until five full turns of the fur brush 71, the toner deposited on the fur brush 71 is inverted in polarity and has a charge amount of +5 μC/g.

The reason why the toner charge amount is lowered is that the positive-polarity cleaning voltage is applied to the fur brush 71 and therefore the electric charges of the toner are gradually taken away. The polarity-inverted toner is not held by the fur brush 71 to which the positive-polarity cleaning voltage is applied, so that the toner is not transferred onto the metal roller 72 which is electrically charged to a positive potential relatively higher than that of the fur brush 71.

As shown in FIG. 6(*c*), the polarity-inverted toner is transferred back to the secondary transfer roller 56 which is negative in potential relative to the fur brush 71 and then is re-transferred onto the intermediary transfer belt 51 by the normal secondary transfer voltage.

The control portion 110 forms the cleaning toner images on the entire circumferential surface of the image carrying member with the interval L2 which is associated with a difference in time between the transfer of the cleaning toner images onto the transfer member and the re-transfer of the cleaning toner images onto the image carrying member.

The re-deposition amount of the toner on the intermediary transfer belt 51 was obtained by directly collecting the toner on the intermediary transfer belt 51 and measuring a weight of the collected toner.

As shown in FIG. 8, the toner of the restoring toner band GE deposited on the secondary transfer roller 56 is returned to the intermediary transfer belt 51 during three or four full turns of the secondary transfer roller 56. For this reason, the interval L2 between adjacent restoring toner bands GE was set at 500 mm which was about 7 times the circumference L3 of the secondary transfer roller 56. It was assumed that the transfer of the toner from the secondary transfer roller 56 onto the fur brush 71 occurred over 3.5 turns of the secondary transfer roller 56 and the transfer from the fur brush 71 onto the secondary transfer roller 56 occurred over 3.5 turns of the secondary transfer roller 56.

About 60% of the restoring toner bands GE having the high density and the large toner amount were returned to the intermediary transfer belt 51 through the secondary transfer roller 56. On the other hand, the control images GY, GM, GC and GK having a relatively low density and a relatively small toner amount are almost transferred onto the metal roller 72 and are scraped off the metal roller 72 by the cleaning blade 73, so that the control images are little returned to the intermediary transfer belt 51.

Incidentally, in a conventional image forming apparatus, such a phenomenon that a toner image for an image remaining on the intermediary transfer belt 51 was transferred onto the secondary transfer roller 56 during restoring after jam clearance of the recording material and thereafter was re-transferred onto the intermediary transfer belt 51. However, the toner image for the image is a normal toner image to be transferred onto the recording material but is not the cleaning toner image to be transferred onto the secondary transfer roller 56.

Further, JP-A 2002-014589 discloses an embodiment in which toner containing an external additive for removing an electric discharge substance which is generated by a charger using corona discharge and is then deposited on a photosensitive drum is supplied. However, in this case, application of the toner onto the entire surface of the intermediary transfer belt 51 having a large surface area consumes a large amount of toner, thus being uneconomical.

The restoring toner bands GE returned to the intermediary transfer belt 51 are then held by fur brushes of a first belt cleaning device 8A and a second belt cleaning device 8B and are subjected to rubbing against the surface of the intermediary transfer belt 51. As a result, the external additive is applied onto the entire circumferential surface of the intermediary transfer belt 51. The intermediary transfer belt 51 has a long circumference incomparable to that of the secondary transfer roller 56, so that as shown in FIG. 4, the external additive is applied onto the intermediary transfer belt 51 in an entire circumferential area of the intermediary transfer belt 51 by forming the restoring toner bands GE plural times.

Comparative Embodiment 1

Figure 9:
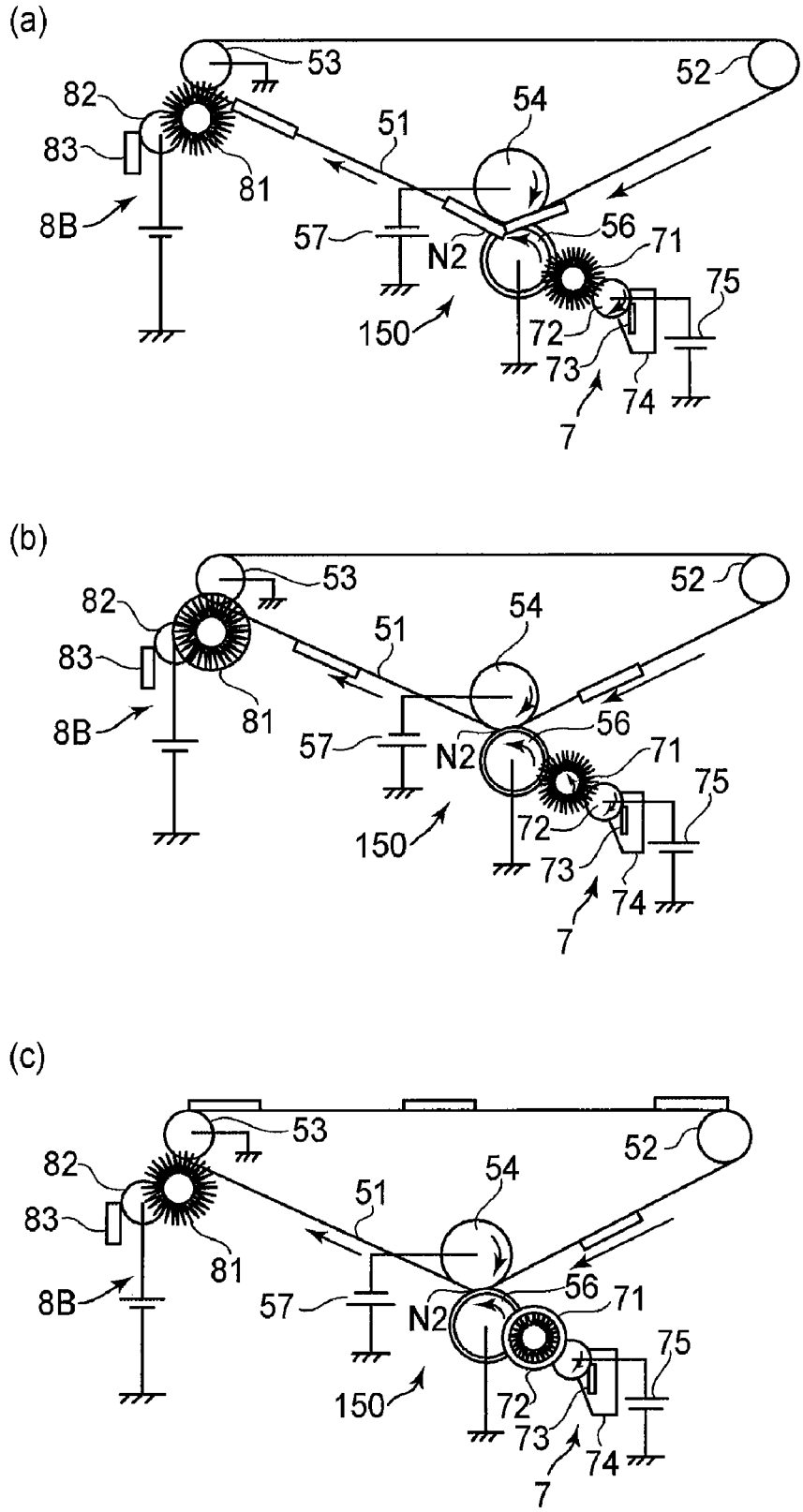
FIGS. 9(*a*), 9(*b*) and 9(*c*) are schematic views illustrating control in Comparative Embodiment 1.

FIGS. 9(*a*), 9(*b*) and 9(*c*) are schematic views for illustrating control in Comparative Embodiment 1. In FIGS. 9(*a*) to 9(*c*), the first cleaning device 8A unassociated with description in this comparative embodiment will be omitted from illustration in these figures.

In control in Comparative Embodiment 1, after the external additive is completely applied onto the intermediary transfer belt 51, the external additive is applied onto the secondary transfer roller 56. In Comparative Embodiment 1, the restoring toner bands GE are carried on the intermediary transfer belt 51 while the intermediary transfer belt 51 is rotated, and thereafter transfer of the restoring toner bands GE onto the secondary transfer roller 56 is started. By transferring the restoring toner bands GE from the intermediary transfer belt 51 onto the secondary transfer roller 56, the external additive is deposited on the surface of the secondary transfer roller 56 and the surface of the intermediary transfer belt 51.

As shown in FIG. 9(*a*), for a period in which the restoring toner bands GE are formed and then are carried on the intermediary transfer belt 51, a secondary transfer voltage of an opposite polarity to that during the normal image formation is applied to the back-up roller 54. The normal secondary transfer voltage is −2000 V to −4000 V but the secondary transfer voltage in Comparative Embodiment 1 is +2000 V to +4000 V. By the secondary transfer voltage of the opposite polarity to that during the normal image formation, the restoring toner bands GE are not transferred onto the secondary transfer roller 56 and are carried by the intermediary transfer belt 51, thus reaching the second belt cleaning device 8B including a fur brush 81 to which a positive-polarity cleaning voltage is applied.

The negatively charged restoring toner bands GE are temporarily removed by cleaning with the fur brush 81 to which the positive-polarity cleaning voltage is applied. In the case of normal transfer residual toner, the toner moved to the fur brush 81 is transferred onto a metal roller 82 and then is scraped off the metal roller 82 by a cleaning blade 83. However, the restoring toner band GE has a large amount of toner and therefore is not transferred onto the metal roller 82 in a short time, thus stagnating on the fur brush 81. By rubbing of the intermediary transfer belt 51 with the fur brush 81 on which the toner stagnates with a difference in speed therebetween, the external additive is efficiently deposited on the surface of the intermediary transfer belt 51.

The toner stagnated on the fur brush 81 is, as described with reference to FIG. 8, re-transferred onto the intermediary transfer belt 51 in the interval L2 between adjacent restoring toner bands GE after being inverted in charge polarity. The toner carried on the intermediary transfer belt 51 is inverted in charge polarity and therefore is secondary-transferred onto the secondary transfer roller 56 during passing of the toner again through the secondary transfer portion N2 to which the secondary transfer voltage of the opposite polarity is applied. In this case, a re-deposition rate of the toner from the fur brush 81 to the intermediary transfer belt 51 was about 60%.

Incidentally, as shown in FIG. 1, by applying a primary transfer voltage (−2500 V) of an opposite polarity to that during the normal image formation to the primary transfer rollers 55*a*, 55*b*, 55*c* and 55*d*, the re-deposited toner is caused to pass through the primary transfer portions N1*a*, N1*b*, N1*c* and N1*d* as it is.

By rubbing between the secondary transfer roller 56 and the fur brush 71 through the toner transferred onto the secondary transfer roller 56, the electric discharge product deposited on both of the secondary transfer roller 56 and the fur brush 71 is removed.

As described above, the external additive is applied onto the intermediary transfer belt 51 and the secondary transfer roller 56.

Comparison Between Embodiment 1 and Comparative Embodiment 1

In order to compare an aging effect in Embodiment 1 with an aging effect in Comparative Embodiment 1, a relationship between a time required for forming the restoring toner band GE (aging time) and an occurrence of the backside contamination was evaluated. Specifically, the restoring toner band GE was formed for 3 minutes with an increment of 30 seconds. After each of aging times, normal image formation was carried out to observe a degree of an occurrence of the backside contamination.

In order to evaluate the aging effect as a numerical value, an amount of deposition of the external additive was monitored. Quantification of the deposition amount was performed by using a fluorescent X-ray analyzer ("SGT-5000T", mfd. by HORIBA, Ltd.). When each of the secondary transfer roller 56 and the intermediary transfer belt 51 was irradiated with fluorescent X-rays, a peak of the external additive (silicon: Si) was converted into a numerical value.

The results are shown in Table 1.

TABLE 1

| Aging time (sec) | *1 B.C. Emb. 1 | *1 B.C. Comp. Emb. 1 | *2 E.A.D.A. Emb. 1 *3 ITB | *2 E.A.D.A. Emb. 1 *4 STR | *2 E.A.D.A. Comp. Emb. 1 *3 ITB | *2 E.A.D.A. Comp. Emb. 1 *4 STR |
|---|---|---|---|---|---|---|
| 0 | B | B | 0 | 0 | 0 | 0 |
| 30 | B | B | 3 | 30 | 1 | 3 |
| 60 | A | B | 30 | 50 | 5 | 5 |
| 90 | A | B | 40 | 60 | 10 | 16 |
| 120 | A | B | 50 | 70 | 15 | 20 |
| 150 | A | B | 55 | 80 | 22 | 30 |
| 180 | A | A | 60 | 90 | 30 | 50 |

*1: "B.C." represents backside contamination. "A" represents that the backside contamination was at a practically acceptable level. "B" represents that the backside contamination was at a practically unacceptable level.
*2: "E.A.D.A." represents an external additive deposition amount (in terms of absolute X-ray intensity).
*3: "ITB" represents the intermediary transfer belt.
*4: "STR" represents the secondary transfer roller.

As shown in Table 1, according to aging in Embodiment 1, the backside contamination of the recording material is eliminated by the aging for 1 minute (60 seconds). On the other hand, according to aging in Comparative Embodiment 1, it takes 3 minutes (180 seconds) until the backside contamination is eliminated. From the measurement of the external additive deposition amount (absolute X-ray intensity) by the fluorescent X-ray analyzer (XGT-5000T), a correlation between the backside contamination and the absolute X-ray intensity was confirmed. Specifically, with respect to the external additive deposition amount by the aging, it can be said that the aging effect is achieved to the extent that the backside contamination is substantially eliminated when the absolute X-ray intensity is 30 or more for the intermediary transfer belt 51 and 50 or more for the secondary transfer roller 56.

The control in Embodiment 1 in superior in elimination of the backside contamination to the control in Comparative Embodiment 1. This is because the secondary transfer roller 56 has the circumference longer than that of the intermediary transfer belt 51 and therefore the secondary transfer roller 56 is subjected to a larger number of electric discharge to be increased in deposition speed of the electric discharge product. For this reason, in order to achieve the aging effect on the secondary transfer roller 56, it is necessary to deposit the external additive on the secondary transfer roller 56 in an amount more than that for the intermediary transfer belt 51.

Therefore, the aging of the secondary transfer roller 56 preceding to that of the intermediary transfer belt 51 leads to reduction in aging time.

In control of this embodiment, during non-image formation, an electric discharge product deposited on the surface of the secondary transfer roller 56 is removed by directly supplying the restoring toner band GE onto the secondary transfer roller 56, so that the surface free energy is lowered. As a result, the control images transferred onto the secondary transfer roller 56 are satisfactorily removed, so that the backside contamination of the recording material and image defect during printing on both sides are prevented.

Further, a good cleaning performance of the fur brush 71 for the secondary transfer roller 56 is always achieved while meeting control images formed at sheet intervals during image formation on various recording materials. As a result, the cleaning performance of the fur brush 71 for the secondary transfer roller in the case of repetitively forming the control images at a predetermined interval between adjacent sheets of recording materials is improved.

<Re-deposition Amount of Toner>

In Table 2, a degree of occurrence of the backside contamination when an amount of toner re-transferred from the secondary transfer roller 56 onto the intermediary transfer belt 51 under the condition in Embodiment 1 is changed by adjusting an output voltage of the cleaning power source 75 is shown. A re-deposition amount shown in Table 2 is a ratio to the toner amount M (mg/cm$^2$) of the restoring toner band GE carried on the intermediary transfer belt 51.

TABLE 2

| *1 R.D.A. | *2 B.C. |
|---|---|
| 0.03M | B |
| 0.05M | B |
| 0.1M | A |
| 0.3M | A |
| 0.5M | A |

*1: "R.D.A." represents the re-deposition amount.
*2: "B.C." represents the backside contamination.
"A" represents that the backside contamination is of practically no problem.
"B" represents that the backside contamination was conspicuous.

As shown in Table 2, it was found that the occurrence of the backside contamination was capable of being suppressed to a practically acceptable level by the re-transfer of the toner onto the intermediary transfer belt 51 in an amount of 10% or more of the toner amount M of the restoring toner band GE.

Embodiment 2

Figure 10:
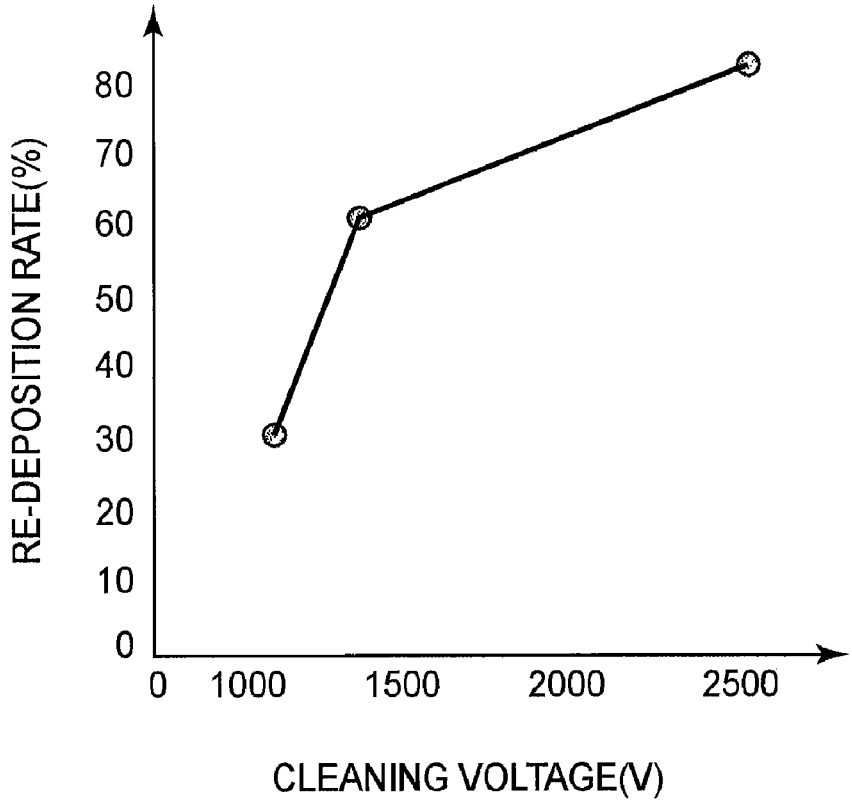
FIG. 10 is a graph showing a relationship between a redeposit rate of the restoring toner band on the intermediary transfer belt and a cleaning voltage.
Figure 11:
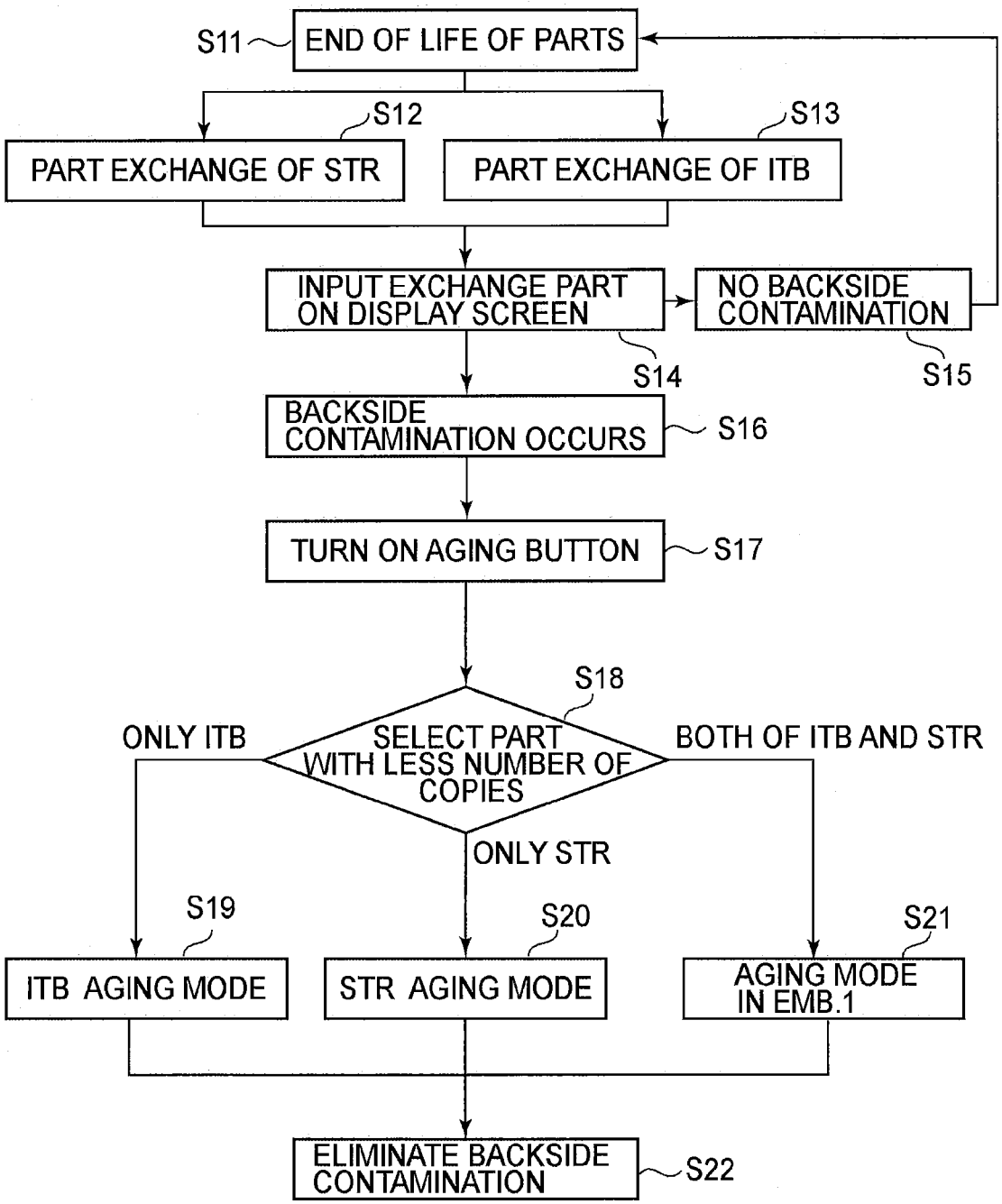
FIG. 11 is a flowchart of control in the Second Embodiment.

FIG. 10 is a graph showing a relationship between the cleaning voltage and a re-deposition rate of the restoring toner band onto the intermediary transfer belt and FIG. 11 is a flowchart of control in Embodiment 2.

In this embodiment, a difference in aging effect when the output voltage from the cleaning power source 75 during the aging will be described.

In this embodiment, the output of the cleaning power source for the transfer member cleaning device 7 is made variable, so that the re-deposition amount of the restoring toner band from the secondary transfer roller 56 onto the intermediary transfer belt 51 is controlled.

As shown in FIG. 10 with reference to FIG. 3, the re-deposition amount of the restoring toner band onto the intermediary transfer belt 51 can be controlled by changing the cleaning voltage applied to the metal roller 72. With a larger cleaning voltage, the re-deposition rate of the restoring toner band onto the intermediary transfer belt 51 increases, so that the aging effect on the intermediary transfer belt 51 can be achieved in a smaller toner amount and a shorter aging time.

The re-deposition rate is 60% at a cleaning voltage of +1500 V but reaches 85% at a cleaning voltage of +2500 V. On the other hand, when the cleaning voltage is +1000 V, the re-deposition rate is lowered to 30%, so that a rubbing time of the secondary transfer roller 56 with the fur brush 71 through the toner is prolonged.

This is because a time required for inverting the triboelectric charge polarity with respect to the fur brush 71 is changed by the cleaning bias. With a higher cleaning voltage, a charge-imparting speed is increased, so that a time required for inverting the toner charge polarity is shorten.

Based on the above-described characteristics, by making three-deposition amount variable, the aging can be optimized in the case where the secondary transfer roller or the intermediary transfer belt is exchanged (replaced) by a user.

When the user exchanges the intermediary transfer belt 51 or the secondary transfer roller 56 because of end of lifetime or the like, the backside contamination is liable to occur compared with the case of the belt or roller before the exchange. This is because, as described above, a sufficient external additive is not deposited on the intermediary transfer belt 51 or the secondary transfer roller 56. Therefore, in the case where the intermediary transfer belt 51 or the secondary transfer roller 56 is exchanged, as described in Embodiment 1, it is desirable that the external additive is applied onto the associated surface by executing the aging in advance to the start of image formation.

In the case of exchange both of the intermediary transfer belt 51 and the secondary transfer roller 56, the aging in Embodiment 1 may be performed as it is but in the case of exchange either one of these members, the associated member may be mainly subjected to the aging.

The control portion 110 increases an absolute value of the cleaning voltage in the case where a cumulative operation time of the transfer member 56 is longer than that of the image carrying member 51 compared with the absolute value of the cleaning voltage in the case where the cumulative operation time of the transfer member 56 is equal to that of the image carrying member 51. However, in the case where the cumulative operation time of the image carrying member 51 is longer than that of the transfer member 56, the absolute value of the cleaning voltage is decreased compared with that in the case where the cumulative operation time of the image carrying member 51 is equal to that of the transfer member 56.

As shown in FIG. 11 with reference to FIG. 1, when the intermediary transfer belt 51 or the secondary transfer roller 56 reaches the end of lifetime (S11), a service person exchanges the intermediary transfer belt 51 or the secondary transfer roller 56 on a customer site (S12, S13). After the exchange, the service person inputs an exchange history through a display screen on the operation panel 108 (FIG. 2) (S14). As a result, the image forming apparatus 100 can manage the end of lifetime in real time.

In the case where the backside contamination occurs on the customer site (S16), when the user pushes an aging button displayed on the operation panel 108 (FIG. 2) (S17), the image forming apparatus 100 counts the end of lifetime of the intermediary transfer belt 51 and the secondary transfer roller 56 and then selects one of three modes (S18).

(1) In the case where only the intermediary transfer belt 51 is exchanged, an intermediary transfer belt restoring mode is executed (S19). In the intermediary transfer belt restoring mode, the cleaning power source 75 applies +2500 V to the metal roller 72, so that the re-deposition amount of the restoring toner band on the intermediary transfer belt 51 is increased and thus the aging effect on the intermediary transfer belt 51 is enhanced.

(2) In the case where only the secondary transfer roller 56 is exchanged, a secondary transfer roller restoring mode is executed (S20). In the secondary transfer roller restoring mode, the cleaning power source 75 applies +1000 V to the metal roller 72, so that a degree of rubbing of the secondary transfer roller 56 with the fur brush 71 through the toner is increased and thus the aging effect on the secondary transfer roller 56 is enhanced.

(3) In the case where both of the intermediary transfer belt 51 and the secondary transfer roller 56 are exchanged, the restoring mode already described in Embodiment 1 is executed (S21). In the restoring mode of Embodiment 1, the cleaning power source 75 applies +1500 V to the metal roller 72.

As a result, the backside contamination of the recording material is eliminated (S22).

Embodiment 3

In Embodiment 3, the aging effect when each of the length L1 of the restoring toner band GE and the interval L2 between adjacent restoring toner bands GE was changed was verified. Specifically, a degree of occurrence of the backside contamination was verified by performing the control in Embodiment 1 while changing the length L1 of the restoring toner band GE in a state in which the backside contamination was accelerated caused to occur by the control in Embodiment 1.

An eliminated state of the backside contamination was confirmed by changing the length L1 of the restoring toner band GE to 0.25 time, 0.5 time, 1.0 time, 1.5 times, 2 times, and 3 times the circumference L3 of the secondary transfer roller 56 of 75.4 mm.

An evaluation result is shown in Table 3.

TABLE 3

| L1 | *1 B.C. |
|---|---|
| L3 × 0.25 | B |
| L3 × 0.5 | B |
| L3 × 1.0 | A |
| L3 × 1.5 | A |
| L3 × 2.0 | A |
| L3 × 3.0 | A |

*1: "B.C." represents the backside contamination.
"A" represents that the backside contamination was at a practically acceptable level.
"B" represents that the backside contamination was at a practically unacceptable level.

As shown in Table 3, when the length L1 of the restoring toner band GE was less than the circumference L3, it was not possible to achieve a sufficient aging effect.

This is because when the amount of toner transferred onto the secondary transfer roller 56 is not large, the toner is transferred onto the metal roller 72 without stagnating on the fur brush 71 and then is increased in rate of the toner scraped off the metal roller 72 by the cleaning blade 73. As a result, the toner carried on the secondary transfer roller 56 is removed by the cleaning before the electric discharge product is sufficiently removed, so that the rubbing of the secondary transfer roller 56 with the fur brush 71 through the toner is not effective. Further, the toner is intermittently carried on the peripheral surface of the secondary transfer roller 56, so that an area in which the electric discharge product is not sufficiently removed is formed. Further, the restoring toner band GE transferred onto the secondary transfer roller 56 is not sufficiently returned to the intermediary transfer belt 51, so that the aging effect on the intermediary transfer belt 51 is also lowered.

Also from a result of analysis using the fluorescent X-ray analyzer (XGT-5000T), when the length L1 of the restoring toner band GE was less than the circumference L3 (75.4 mm) of the secondary transfer roller 56, the deposition of the external additive on the intermediary transfer belt 51 was not observed (the result of the control image shown in FIG. 8).

Therefore, in order to satisfactorily achieve the aging effect, it is important that a relationship: L3≦L1 is satisfied.

Next, in a state in which the length L1 of the restoring toner band GE was set at a value satisfying L3≦L1, the aging effect was verified when the interval L2 between adjacent restoring toner bands GE was changed in a range of L1<L2<(7×L1). As a result, with respect to all the intervals L2, a good cleaning performance of the transfer member cleaning device 7 was confirmed.

The length of the cleaning toner image is taken as L1 (mm) and the toner amount per unit area is taken as M (mg/cm$^2$) which is larger than that of the toner image for control. Further, the circumference of the transfer member 56 is taken as L3 (mm) and the surface movement speed of the transfer member 56 is taken as P (mm/sec). In this case, at least after a lapse of a time of L3/P (sec) from the transfer of the toner image onto the transfer member 56, the toner is re-transferred onto the image carrying member 51 in a maximum re-deposition amount of 0.1×M (mg/cm$^2$) or more.

As described above, according to the present invention, it is possible to suppress a lowering in cleaning performance of the transfer member cleaning device for the transfer member irrespective of a state of the image carrying member contacting the transfer member.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 018725/2008 filed Jan. 30, 2008, which is hereby incorporated by reference.

What is claimed is:

1. An image forming apparatus comprising:

an image carrying member;

toner image forming means for forming a toner image and an adjusting image, for adjusting a toner image forming condition, on said image carrying member;

a transfer member, contactable to said image carrying member, for forming a transfer portion for transferring a toner image from said image carrying member onto a recording material, wherein when an image is continuously formed on recording materials, the adjusting image is formed on said image carrying member, by said toner image forming means, in an area corresponding to an area between the recording material and a subsequent recording material and then is deposited on said transfer member, which is in contact with said image carrying member;

voltage applying means for applying a voltage to said transfer member;

a cleaning member, contactable to said transfer member, for removing toner from said transfer member; and a control portion for (i) controlling said toner image forming means so that a toner band is formed on said image carrying member with an amount of toner per unit area equal to or larger than that of the adjusting image and is formed in a length not less than a circumferential length of said transfer member, and (ii) controlling said voltage applying means so that the toner band is electrostatically transferred onto at least an area of said transfer member on which the adjusting image is deposited, and then the toner band is electrostatically transferred from said transfer member onto said image carrying member.

2. An apparatus according to claim 1, wherein said toner band is provided in a plurality of toner band portions with intervals at which the toner on said transfer member is transferred onto said image carrying member.

3. An apparatus according to claim 2, wherein the intervals are set in association with a difference in time between transfer of the toner band onto said transfer member and transfer of the toner band onto said image carrying member.

4. An apparatus according to claim 1, wherein said image forming apparatus further comprises an image carrying member cleaning device for removing the toner which has passed through the transfer portion and has been deposited on said image carrying member, and wherein said control portion stops said image carrying member after the toner band is formed and thereafter the toner transferred onto said image carrying member is removed by said image carrying member cleaning device.

5. An apparatus according to claim 1, wherein said cleaning member is an electroconductive roller brush which rotates and rubs against said transfer member, wherein said image forming apparatus further comprises a transfer member cleaning device comprising: said cleaning member, a metal roller for rubbing against the electroconductive roller brush, a cleaning blade brought into contact with said metal roller, and a cleaning power source for continuously applying a cleaning voltage of a polarity opposite to a charge polarity of the toner to said metal roller so that the charge polarity of the toner electrostatically removed from said transfer member is inverted and then the toner is re-transferred electrostatically onto said transfer member, and wherein said control portion controls said image forming portion so that the toner band is formed in a length equal to or longer than a circumference of said transfer member.

6. An apparatus according to claim 5, wherein said control portion increases an absolute value of the cleaning voltage, when a cumulative operation time of said transfer member is longer than that of said image carrying member, compared with the absolute value of the cleaning voltage when the cumulative operation time of said transfer member is equal to that of said image carrying member, and wherein said control portion decreases the absolute value of the cleaning voltage, when a cumulative operation time of said image carrying member is longer than that of said transfer member, compared with the absolute value of the cleaning voltage when the cumulative operation time of said image carrying member is equal to that of said transfer member.

7. An apparatus according to claim 6, wherein said image forming apparatus further comprises a plurality of developing devices different in color of toner used, and wherein said control portion forms the toner band by using the developing device for toner having a smallest contrast with respect to the recording material.

8. An image forming apparatus comprising:

an image carrying member;

toner image forming means for forming a toner image and an adjusting image, for adjusting a toner image forming condition, on said image carrying member;

a transfer member, contactable to said image carrying member, for forming a transfer portion for transferring a toner image from said image carrying member onto a recording material, wherein when an image is continuously formed on recording materials, the adjusting image is formed on said image carrying member, by said toner image forming means, in an area corresponding to an area between the recording material and a subsequent recording material and then is deposited on said transfer member, which is in contact with said image carrying member;

voltage applying means for applying a voltage to said transfer member;

a cleaning member, contactable to said transfer member, for removing toner from said transfer member in a cleaning area; and a control portion for (i) controlling said toner image forming means so that a toner band is formed with an amount of toner larger than an amount of toner removable by said cleaning member at one time and is formed in a length not less than a circumferential length of said transfer member, and (ii) controlling said voltage applying means so that the toner band is electrostatically transferred onto at least an area of said transfer member in which the adjusting image is deposited, and then the toner band is electrostatically transferred from said transfer member onto said image carrying member.

9. An image forming apparatus comprising:

an image carrying member;

toner image forming means for forming a toner image and an adjusting image, for adjusting a toner image forming condition, on said image carrying member;

a transfer member, contactable to said image carrying member, for forming a transfer portion for transferring a toner image from said image carrying member onto a recording material, wherein when an image is continuously formed on recording materials, the adjusting image is formed on said image carrying member, by said toner image forming means, in an area corresponding to an area between the recording material and a subsequent recording material and then is deposited on said transfer member, which is in contact with said image carrying member;

voltage applying means for applying, to said transfer member, a transfer voltage for transferring the toner image;

a cleaning member, contactable to said transfer member, for removing toner electrostatically from said transfer member; and a control portion for executing an operation in a mode in which said voltage applying means applies, in a state in which there is no recording material at a transfer portion, a voltage of an identical polarity to that of the transfer voltage in a period from transfer of a toner band, after being formed by said toner image forming means in a length not less than a circumferential length of said transfer member and with an amount of toner per unit area equal to or larger than that of the adjusting image and then being electrostatically transferred from said image carrying member onto said transfer member, onto said transfer member until said transfer member rotates one full turn or more.

* * * * *